US009971264B2

(12) United States Patent
Sano et al.

(10) Patent No.: US 9,971,264 B2
(45) Date of Patent: May 15, 2018

(54) MAGNETIC TONER

(71) Applicant: CANON KABUSHIKI KAISHA, Tokyo (JP)

(72) Inventors: Tomohisa Sano, Mishima (JP); Yusuke Hasegawa, Suntou-gun (JP); Shuichi Hiroko, Tokyo (JP); Yoshitaka Suzumura, Mishima (JP); Keisuke Tanaka, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 14/694,812

(22) Filed: Apr. 23, 2015

(65) Prior Publication Data

US 2015/0227068 A1 Aug. 13, 2015

Related U.S. Application Data

(63) Continuation of application No. PCT/JP2014/084068, filed on Dec. 24, 2014.

(30) Foreign Application Priority Data

Dec. 26, 2013 (JP) ..... 2013-269666

(51) Int. Cl.
*G03G 9/083* (2006.01)
*G03G 9/087* (2006.01)
(Continued)

(52) U.S. Cl.
CPC ..... *G03G 9/0839* (2013.01); *G03G 9/083* (2013.01); *G03G 9/0821* (2013.01); *G03G 9/0827* (2013.01); *G03G 9/0835* (2013.01); *G03G 9/0836* (2013.01); *G03G 9/08706* (2013.01); *G03G 9/08711* (2013.01);
(Continued)

(58) Field of Classification Search
CPC ..... G03G 9/083; G03G 9/0836
See application file for complete search history.

(56) References Cited

U.S. PATENT DOCUMENTS 5,456,990 A 10/1995 Takagi et al.
5,508,139 A 4/1996 Tanaka et al.
(Continued)

FOREIGN PATENT DOCUMENTS

JP 6-273974 A 9/1994
JP 2002-62683 A 2/2002
(Continued)

*Primary Examiner* — Hoa V Le
(74) *Attorney, Agent, or Firm* — Fitzpatrick Cella Harper and Scinto

(57) ABSTRACT

The magnetic toner contains a magnetic toner particle having a binder resin and a magnetic body, and inorganic fine particles, wherein the average circularity of the magnetic toner is at least 0.955 and, when classifying the inorganic fine particles, in accordance with the fixing strength thereof to the magnetic toner particle and in the sequence of the weakness of the fixing strength, as first inorganic fine particles, second inorganic fine particles, and third inorganic fine particles, the content of the first inorganic fine particles, the ratio of the second inorganic fine particles to the first inorganic fine particles, and the coverage ratio X are in prescribed ranges.

14 Claims, 8 Drawing Sheets

(51) Int. Cl.
*G03G 9/097* (2006.01)
*G03G 9/08* (2006.01)

(52) U.S. Cl.
CPC ..... *G03G 9/08795* (2013.01); *G03G 9/09708* (2013.01); *G03G 9/09725* (2013.01)

(56) References Cited

U.S. PATENT DOCUMENTS 7,160,660 B2 1/2007 Dojo et al.
7,273,686 B2 * 9/2007 Onuma ..... G03G 9/0817 430/106.1
7,368,211 B2 5/2008 Hasegawa et al.
7,470,494 B2 12/2008 Nishiyama et al.
7,678,523 B2 3/2010 Hiroko et al.
7,678,524 B2 3/2010 Hasegawa et al.
7,935,467 B2 5/2011 Dojo et al.
7,939,231 B2 5/2011 Ogawa et al.
8,124,306 B2 2/2012 Hirata et al.
8,227,162 B2 7/2012 Sano et al.
8,426,091 B2 4/2013 Magome et al.
8,426,094 B2 4/2013 Magome et al.
8,518,620 B2 8/2013 Dojo et al.
8,728,693 B2 5/2014 Hamano et al.
9,029,055 B2 5/2015 Aoki et al.
9,097,997 B2 * 8/2015 Nomura ..... G03G 9/083
9,152,065 B2 * 10/2015 Sano ..... G03G 9/0833
9,213,251 B2 * 12/2015 Ohmori ..... G03G 9/0821
9,244,371 B2 * 1/2016 Suzumura ..... G03G 9/0835
9,417,542 B2 * 8/2016 Hiroko ..... G03G 9/0833
2009/0197192 A1 8/2009 Hiroko et al.
2012/0214097 A1 * 8/2012 Naka ..... G03G 9/107 430/111.32
2013/0164671 A1 * 6/2013 Matsui ..... G03G 9/0802 430/123.56
2013/0236824 A1 * 9/2013 Yoon ..... G03G 9/08 430/108.6
2014/0030645 A1 1/2014 Nomura et al.
2014/0302433 A1 10/2014 Hasegawa et al.
2014/0315125 A1 10/2014 Matsui et al.
2014/0315126 A1 10/2014 Magome et al.
2014/0322639 A1 10/2014 Suzumura et al.
2014/0322640 A1 10/2014 Tanaka et al.
2014/0335449 A1 11/2014 Uratani et al.
2014/0335450 A1 11/2014 Nomura et al.
2014/0342277 A1 11/2014 Ohmori et al.
2014/0342278 A1 11/2014 Sano et al.
2014/0370431 A1 12/2014 Hiroko et al.
2015/0227067 A1 * 8/2015 Hasegawa ..... G03G 9/0835 430/108.6

FOREIGN PATENT DOCUMENTS

JP 2005-134751 A 5/2005
JP 2009-186812 A 8/2009
JP 2009-229785 A 10/2009
JP 2010-60768 A 3/2010
JP 2010-160234 A 7/2010
JP 2012-203368 A 10/2012
JP 2013-152460 A 8/2013

* cited by examiner

MAGNETIC TONER

This application is a continuation of International Application No. PCT/JP2014/084068, filed Dec. 24, 2014, the contents of which are incorporated by reference herein.

TECHNICAL FIELD

The present invention relates to a magnetic toner that is used in recording methods that use, for example, an electrophotographic method.

BACKGROUND ART

Image-forming apparatuses, e.g., copiers and printers, have in recent years been subjected to greater diversity in their intended uses and use environments as well as demands for greater speed, higher image quality, and greater stability. For example, printers, which in the past have been used mainly in the office, have also entered into use in severe environments, e.g., high temperatures, high humidities, and it is critical even in such instances that a stable image quality be provided.

Copiers and printers are also undergoing apparatus downsizing as well as advances in energy efficiency, and the use is preferred within this context of magnetic single-component developing systems that use a favorable magnetic toner.

In a magnetic single-component developing system, a magnetic toner layer is formed by a toner layer thickness control member (referred to herebelow as the developing blade) on a toner-bearing member (referred to herebelow as the developing sleeve) that is provided in its interior with a magnetic field-generating means such as a magnet roll. Development is carried out by transporting this magnetic toner layer to the developing zone using the developing sleeve.

Charge is imparted to the magnetic toner by the friction generated when the developing blade and the developing sleeve come into contact in the contact region between the developing blade and the developing sleeve (referred to herebelow as the blade nip region).

Reducing the diameter of the developing sleeve is a critical technology for reducing the size of the apparatus. With a reduced-diameter developing sleeve, the area of contact by the sleeve with the toner at the back of the sleeve is made small and as a consequence the charging opportunity is reduced. In addition, the developing zone at the developing nip region is narrowed and fly over by the magnetic toner from the developing sleeve is then impaired and the magnetic toner with a weak charging performance, i.e., a weak developing strength, will readily remain on the developing sleeve.

In this case, turn over of the magnetic toner in the magnetic toner layer within the blade nip deteriorates and charge rise by the magnetic toner is impaired.

In addition, when the diversification of the use environment is considered, it can be assumed that the magnetic toner will, for example, also undergo long-term standing in high-temperature, high-humidity environments. In such instances, the external additive attached to the magnetic toner surface undergoes a partial embedding due to softening by the resin component of the magnetic toner. When an extended durability test is carried out in this state, the external additive undergoes additional embedding due to the shear received by the magnetic toner in the blade nip region, and in the latter half of the extended durability test the flowability of the magnetic toner declines and charge rise is impeded.

In particular, with magnetic toners the dispersibility of the magnetic body readily exercises a substantial effect on the charging performance, as compared to magnetic body-free nonmagnetic toners, and various image defects are readily produced when the rise in the amount of charge on the magnetic toner is impeded.

To respond to this problem, numerous methods have been proposed in which the dielectric properties, which are an index for the state of the dispersion of the magnetic body within a magnetic toner, are controlled in order to bring about a stabilization of the changes in the developing performance that accompany changes in the environment.

For example, in Patent Document 1 the dielectric loss tangent (tan δ) in a high-temperature range and the normal temperature range is controlled in an attempt to reduce the variations in toner charging performance associated with variations in the environment.

While certain effects are in fact obtained under certain prescribed conditions, in particular adequate consideration is not given to a high degree of starting material dispersity for the case of a high magnetic body content, and there is still room for improvement with regard to the charge rising performance of magnetic toners and their fixing performance.

In order to suppress environmental variations by toners, Patent Document 2 discloses a toner for which the ratio between the saturation water content HL under low-temperature, low-humidity conditions and the saturation water content HH under high-temperature, high-humidity conditions is brought into a prescribed range.

This control of the water content does in fact provide certain effects for the image density reproducibility and transferability under certain prescribed conditions. However, no mention is made in particular of the charge rising performance and the fixing performance when the magnetic body is incorporated as a colorant in the reasonable amount, and this is inadequate for obtaining the effects of the present invention.

Patent Document 3 discloses an image-forming apparatus that contains toner particles as well as spherical particles that have a number-average particle diameter of from 50 nm to 300 nm, wherein the free ratio of these spherical particles is from 5 volume % to 40 volume %. This has a certain effect with regard to inhibiting, in a prescribed environment, contamination of the image carrier, scratching of the image carrier and intermediate transfer member, and image defects.

Patent Document 4, on the other hand, discloses a toner in which large-diameter particles are anchored and small-diameter particles are externally added. This supports an improvement in the fixing releasability and a stabilization of the toner flowability and makes it possible to obtain a pulverized toner with excellent charging, transport, and release properties.

Patent Document 5 discloses an art in which the coating state for an external additive is controlled and the dielectric properties of the toner are also controlled and that is effective mainly for the issue of streak prevention.

In these inventions, however, the free ratio of the spherical particles or large-diameter particles, as inferred from the anchoring conditions or free conditions of these particles, is relatively high, and control of the state of attachment of inorganic fine particles that are otherwise added is inadequate.

Due to this, the charge rising performance for magnetic toners is inadequate—for example, when an extended durability test is run after storage in a high-temperature, high-humidity environment, under which circumstances the state of attachment of inorganic fine particles is already susceptible to variation—and the effects pursued by the present invention are not obtained.

They are also inadequate with regard to control of the resin composition and/or viscosity and are thus unsatisfactory from the standpoint of securing the fixation temperature region intended for the present invention.

That is, there is still room for improvement with regard to obtaining a high quality image through a magnetic toner that regardless of the storage environment is capable of the long-term retention of an excellent charge rising performance and also has a broad fixation temperature region.

CITATION LIST

Patent Literature

[PTL 1] Japanese Patent Application Laid-open No. 2005-134751

[PTL 2] Japanese Patent Application Laid-open No. 2009-229785

[PTL 3] Japanese Patent Application Laid-open No. 2009-186812

[PTL 4] Japanese Patent Application Laid-open No. 2010-60768

[PTL 5] Japanese Patent Application Laid-open No. 2013-152460

SUMMARY OF INVENTION

Technical Problems

The present invention provides a magnetic toner that can solve the problems identified above. That is, the present invention provides a magnetic toner that regardless of the storage environment is capable of the long-term retention of an excellent charge rising performance and also has a broad fixation temperature region.

The present inventors discovered that the problems identified above can be solved by having the inorganic fine particles reside in a prescribed state of attachment to a magnetic toner particle that has a high circularity, and achieved the present invention based on this discovery.

That is, the present invention is as follows:

a magnetic toner that contains a magnetic toner particle containing a binder resin and a magnetic body, and inorganic fine particles fixed to the surface of the magnetic toner particle, wherein the average circularity of the magnetic toner is at least 0.955, and when classifying the inorganic fine particles, in accordance with the fixing strength thereof to the magnetic toner particle and in the sequence of the weakness of the fixing strength, as first inorganic fine particles, the fixing strength thereof being weak, second inorganic fine particles, the fixing strength thereof being medium, and third inorganic fine particles, the fixing strength thereof being strong, (1) the content of the first inorganic fine particles is from 0.10 mass parts to 0.30 mass parts in 100 mass parts of the magnetic toner;

(2) the second inorganic fine particles are present at from 2.0-times to 5.0-times the first inorganic fine particles; and (3) the coverage ratio X of the magnetic toner surface by the third inorganic fine particles, as determined with an x-ray photoelectron spectrometer (ESCA), is from 60.0 area % to 90.0 area %, and wherein the first inorganic fine particles are inorganic fine particles that are detached when a dispersion provided by the addition of the magnetic toner to surfactant-containing ion-exchanged water is shaken for 2 minutes at a shaking velocity of 46.7 cm/sec and a shaking amplitude of 4.0 cm, the second inorganic fine particles are inorganic fine particles that are not detached by the shaking, but are detached by ultrasonic dispersion for 30 minutes at an intensity of 120 W/cm$^2$, and the third inorganic fine particles are inorganic fine particles that are not detached by the shaking and the ultrasonic dispersion.

Advantageous Effects of Invention

The present invention can provide a magnetic toner that, even when subjected to long-term storage, can maintain an excellent charge rising performance and has a broad fixation temperature region.

DESCRIPTION OF EMBODIMENTS

Figure 1:
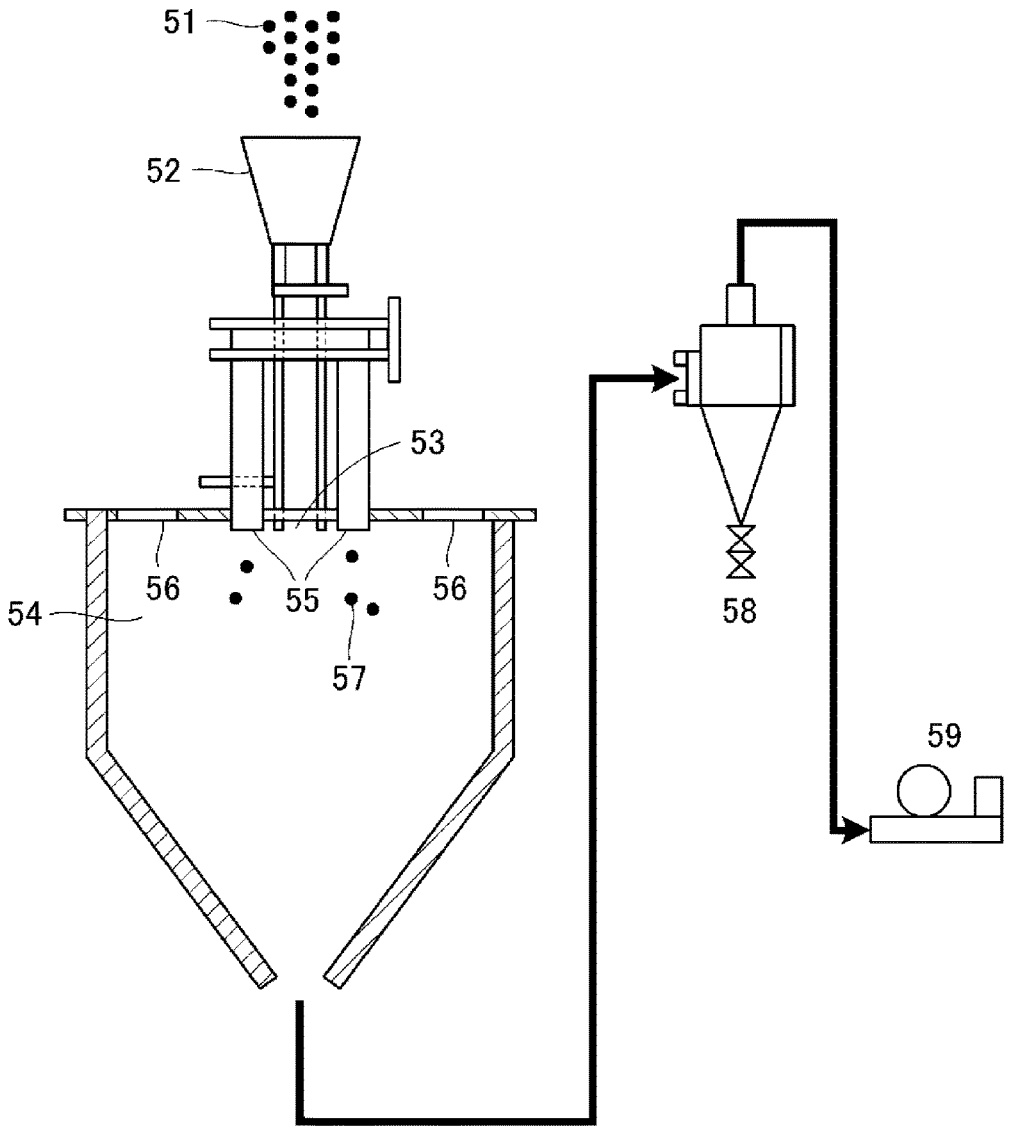
FIG. 1 is a diagram that shows an example of a surface modification apparatus that is preferably used in the present invention.

The present invention is described in detail in the following.

The present invention relates to a magnetic toner that contains a magnetic toner particle containing a binder resin and a magnetic body, and inorganic fine particles fixed to the surface of the magnetic toner particle, wherein the average circularity of the magnetic toner is at least 0.955, and, when classifying the inorganic fine particles, in accordance with the fixing strength thereof to the magnetic toner particle and in the sequence of the weakness of the fixing strength, as first inorganic fine particles, the fixing strength thereof being weak, second inorganic fine particles, the fixing strength thereof being medium, and third inorganic fine particles, the fixing strength thereof being strong, (1) the content of the first inorganic fine particles is from 0.10 mass parts to 0.30 mass parts in 100 mass parts of the magnetic toner;

(2) the second inorganic fine particles are present at from 2.0-times to 5.0-times the first inorganic fine particles; and (3) the coverage ratio X of the magnetic toner surface by the third inorganic fine particles, as determined with an x-ray photoelectron spectrometer (ESCA), is from 60.0 area % to 90.0 area %, and wherein the first inorganic fine particles are inorganic fine particles that are detached when a dispersion provided by the addition of the magnetic toner to surfactant-containing ion-exchanged water is shaken for 2 minutes at a shaking velocity of 46.7 cm/sec and a shaking amplitude of 4.0 cm, the second inorganic fine particles are inorganic fine particles that are not detached by the shaking, but are detached by ultrasonic dispersion for 30 minutes at an intensity of 120 W/cm$^2$, and the third inorganic fine particles are inorganic fine particles that are not detached by the shaking and the ultrasonic dispersion.

According to investigations by the present inventors, a magnetic toner that exhibits an excellent charge rising performance (also referred to hereafter as a rapid charging performance)—even under circumstances of extended use after long-term storage—can be provided by the use of the aforementioned magnetic toner.

It is unclear as to why these properties can be provided through a fine control—through, for example, differences in the fixing strength—of the status of the inorganic fine particles that are added to a magnetic toner, but the present inventors hypothesize as follows.

First, it is crucial for the present invention that the coverage ratio X of the magnetic toner surface by the third inorganic fine particles, as determined with an x-ray photoelectron spectrometer (ESCA), be from 60.0 area % to 90.0 area %. From 63.0 area % to 85.0 area % is preferred and from 65.0 area % to 80.0 area % is more preferred.

First, this concerns the third inorganic fine particles in the present invention, and these denote the inorganic fine particles that are not detached from the magnetic toner particle surface even when the magnetic toner is dispersed in water and subjected to a strong shear using ultrasound. It is thought that due to this the third inorganic fine particles are embedded in the magnetic toner particle surface with the formation of a unified body.

The specification that the coverage ratio X by the third inorganic fine particles be at least 60.0 area % means that inorganic fine particles are strongly implanted in a large portion of the magnetic toner particle surface and reside in a state with a certain degree of embedding. It is difficult for these inorganic fine particles to undergo further embedding into the magnetic toner particle and it is thus difficult for changes to occur beyond this. It is thought that as a consequence the initial state can be retained even in the event of long-term storage under circumstances where inorganic fine particle embedding is easily induced, such as in a high-temperature, high-humidity environment.

In addition, inorganic fine particles generally have a better flowability than does the magnetic toner particle surface. It is thought that a magnetic toner particle surface covered with inorganic fine particles assumes a surface state near that of the inorganic fine particles, thereby yielding an excellent flowability and providing an excellent rapid charging performance as a result.

Thus, covering the magnetic toner particle surface with the third inorganic fine particles makes it possible to maintain an excellent rapid charging performance even during long-term storage and extended use.

The coverage ratio X can be controlled through, for example, the number-average particle diameter, amount of addition, external addition conditions, and so forth, for the third inorganic fine particles.

When the third inorganic fine particles are scarce, i.e., when the coverage ratio X by the third inorganic fine particles is less than 60.0 area %, inorganic fine particles will continue to embed, due to durability testing or long-term storage, in the exposed regions of the magnetic toner particle surface. When this occurs, motion by the toner layer on the developing sleeve is impaired to some degree and as a consequence the rapid charging performance of the magnetic toner assumes a declining trend.

When, on the other hand, the third inorganic fine particles are abundant, that is, the coverage ratio X by the third inorganic fine particles exceeds 90.0 area %, heat transfer to the magnetic toner particle is impaired and heat fixing is then impaired. In addition, when complete coverage by the third inorganic fine particles ends up occurring, control of the second inorganic fine particles and the first inorganic fine particles, infra, is then impeded.

Here, the aforementioned effects due to the third inorganic fine particles are seen to a quite substantial degree when the magnetic toner has a high circularity. That is, an average circularity for the magnetic toner of at least 0.955 is crucial. From 0.957 to 0.980 is more preferred. A magnetic toner with a high circularity presents a surface with little unevenness, and as a consequence the coverage ratio X by the third inorganic fine particles is then easily controlled into the previously indicated range and a uniform coverage is also easily achieved. Due to this, the embedding of inorganic fine particles that is caused by long-term standing and durability testing can be suppressed. In the case of a low average circularity, i.e., of less than 0.955, there is a tendency for deterioration phenomena to progress, during durability testing or long-term storage, starting from regions where fixing of the inorganic fine particles is impeded, for example, at protruded portions. The average circularity can be adjusted into the indicated range through the method of magnetic toner production and through adjustment of the production conditions.

It is also crucial for the present invention that, in addition to the third inorganic fine particles on the magnetic toner surface, the second inorganic fine particles and first inorganic fine particles be present in suitable amounts.

Here, in order to maintain the rapid charging performance to a high degree, it is crucial that the second inorganic fine particles and first inorganic fine particles satisfy the following conditions.

It is crucial for the toner of the present invention that the fixing status of the inorganic fine particles be controlled such that the second inorganic fine particles are present at from 2.0-times to 5.0-times the first inorganic fine particles. The method for exercising this control can be exemplified by a method in which a two-stage mixing is implemented in the external addition step with adjustment of the amount of addition and the external addition strength for each of the inorganic fine particles in the first-stage external addition step and the second-stage external addition step. This ratio can also be controlled through judicious selection of the number-average particle diameter of the inorganic fine particles that are caused to be weakly fixed and the inorganic fine particles that are caused to be medium-fixed. The second inorganic fine particles are more preferably from 2.2-times to 5.0-times and even more preferably from 2.5-times to 5.0-times the first inorganic fine particles.

It is also crucial for the content of the first inorganic fine particles to be from 0.10 mass parts to 0.30 mass parts in 100 mass parts of the magnetic toner. From 0.12 mass parts to 0.27 mass parts is preferred and from 0.15 mass parts to 0.25 mass parts is more preferred.

The method for controlling the content of the first inorganic fine particles into the indicated range can be exemplified by exercising control by adjusting the amount of addition of the inorganic fine particles and adjusting the respective first stage and second stage external addition conditions using the two-stage mixing referenced above.

While the method for measuring the amount of first inorganic fine particles is described below, it is thought that the first inorganic fine particles can behave relatively freely at the magnetic toner surface. It is thought that the lubricity within the magnetic toner can be raised and a cohesive force-reducing effect can be exhibited by having the first inorganic fine particles be present at from 0.10 mass parts to 0.30 mass parts in 100 mass parts of the magnetic toner.

This lubricity and cohesive force-reducing effect are not obtained to a satisfactory degree at less than 0.10 mass parts. At above 0.30 mass parts, the lubricity readily becomes higher than necessary and the magnetic toner is prone to become densely congested and the flowability is then conversely prone to decline.

While the method for measuring the second inorganic fine particles is also described below, it is thought that the second inorganic fine particles, while being more embedded than the first inorganic fine particles, are more exposed at the magnetic toner particle surface than are the third inorganic fine particles.

The present inventors hypothesize that these second inorganic fine particles, due to their status of being suitably exposed while also being anchored, exert the effect of causing rotation of the magnetic toner when the magnetic toner is in a compacted state, for example, within the blade nip or at the back of the developing sleeve. When this occurs, not only does the magnetic toner rotate, but it is thought that, through interactions such as an intermeshing with the second inorganic fine particles on the surface of other magnetic toner particles, an effect accrues whereby the other magnetic toner particles are also induced to rotate.

That is, it is thought that the magnetic toner undergoes rapid charging due to a substantial mixing of the magnetic toner within the magnetic toner layer at the blade nip region as brought about by the action of the second inorganic fine particles, coupled with the charging induced by friction within the magnetic toner.

In addition, when the magnetic toner compacted at the back of the developing sleeve assumes a packed condition, the magnetic toner layer at the blade nip region is prone to become undesirably thick due to the feed of partially aggregated magnetic toner to the developing sleeve.

As a result, turn over of the magnetic toner in the blade nip region becomes slow and the rapid charging performance of the magnetic toner readily becomes unsatisfactory.

In order for the action of the second inorganic fine particles to be maximally expressed, it is critical that the state of fixing of the inorganic fine particles be controlled so that, as previously indicated, the second inorganic fine particles are present at from 2.0-times to 5.0-times the first inorganic fine particles.

When the second inorganic fine particles and the first inorganic fine particles reside in the indicated quantitative ratio relationship, for the first time a uniform magnetic toner layer is formed on the developing sleeve by the magnetic toner at the back of the developing sleeve, and the magnetic toner layer at the blade nip region also continues to be rapidly mixed. It is thought that this functions to substantially improve the rapid charging performance of the magnetic toner in the magnetic toner layer on the developing sleeve.

When the second inorganic fine particles exceed 5.0-times the first inorganic fine particles, the actions with regard to lubricity and cohesive force reduction become weaker than the intermeshing action due to the second inorganic fine particles. As a result, the effect of an acceleration of the mixing at the back of the developing sleeve and the mixing of the magnetic toner layer in the blade nip region is not obtained.

When, on the other hand, the second inorganic fine particles are less than 2.0-times the first inorganic fine particles, the intermeshing action by the second inorganic fine particles is not adequately obtained and, as above, the mixing-acceleration effect again cannot be adequately obtained.

These effects of increasing and maintaining the rapid charging performance can be obtained for the first time when the coverage ratio X by the third inorganic fine particles is from 60.0 area % to 90.0 area % and the average circularity is also at least 0.955.

Here, when the coverage ratio X by the third inorganic fine particles exceeds 90.0 area %, it then becomes difficult to control the quantitative ratio relationship between the second inorganic fine particles and the first inorganic fine particles into the range of the present invention—and in addition the previously described low-temperature fixability is impaired.

Moreover, when the average circularity is less than 0.955, the magnetic toner surface assumes a substantial unevenness, making it difficult to achieve a uniform coverage by the inorganic fine particles. As a consequence, the intermeshing effect between the second inorganic fine particles is reduced, as is the lubricity-improving effect due to the first inorganic fine particles.

The present inventors experimentally discovered that the ratio of the number-average particle diameter (D1) of the primary particles of the third inorganic fine particles to the number-average particle diameter (D1) of the primary particles of the first inorganic fine particles (D1 of the third inorganic fine particles/D1 of the first inorganic fine particles) is preferably from 4.0 to 25.0, is more preferably from 5.0 to 20.0, and even more preferably is from 6.0 to 15.0.

The reason for this is not clear, but the following is hypothesized.

It is thought that the utilization of a sliding action between the inorganic fine particles present on the magnetic toner particle surfaces is very effective for inducing an even greater expression of the lubricity improvement within the magnetic toner and the cohesive force-reducing effect that are brought about, as discussed above, by the first inorganic fine particles.

To this end, moreover, it is thought that the sliding action can be maximally utilized when the area occupied by a particle of the inorganic fine particles that are strongly fixed to the magnetic toner particle surface, is larger than for the first inorganic fine particles, which are capable of a relatively free behavior.

When the ratio of the number-average particle diameter (D1) of the primary particles of the third inorganic fine particles to the number-average particle diameter (D1) of the primary particles of the first inorganic fine particles is less than 4.0, it then tends to be difficult to obtain the sliding action between inorganic fine particles to a satisfactory extent.

When, on the other hand, this ratio exceeds 25.0, since the third inorganic fine particles are then significantly larger than the first inorganic fine particles, it tends to be difficult to satisfy the preferred amount for the first inorganic fine particles and it also tends to be difficult to inhibit the embedding that accompanies extended durability testing.

The number-average particle diameter (D1) of the primary particles of the third inorganic fine particles is preferably from 50 nm to 200 nm, more preferably from 60 nm to 180 nm, and even more preferably from 70 nm to 150 nm.

When the number-average particle diameter (D1) of the primary particles of the third inorganic fine particles is less than 50 nm, it is then difficult to obtain the sliding action mentioned above to a satisfactory degree and it also tends to be difficult to suppress the embedding of the first inorganic fine particles and second inorganic fine particles that accompanies extended durability testing.

On the other hand, it tends to be difficult to adjust the coverage ratio X of the magnetic toner surface by the third inorganic fine particles to equal to or greater than 60.0 area % when the number-average particle diameter (D1) of the primary particles of the third inorganic fine particles exceeds 200 nm.

The number-average particle diameter (D1) of the primary particles of the third inorganic fine particles can be controlled through judicious selection of the inorganic fine particles that are caused to be strongly fixed.

The number-average particle diameter (D1) of the primary particles of the first inorganic fine particles and/or the second inorganic fine particles is preferably from 5 nm to 30 nm. From 5 nm to 25 nm is more preferred, and from 5 nm to 20 nm is even more preferred.

By satisfying this range, the lubricity and cohesive force-reducing effect are readily expressed with the first inorganic fine particles. The intermeshing-induced stirring effect for the magnetic toner is also readily expressed with the second inorganic fine particles.

The dielectric loss tangent (tan δ) for the magnetic toner in the present invention is preferably not more than $6.0\times10^{-3}$ at a frequency of 100 kHz and a temperature of 30° C.

Here, the frequency condition for measuring the dielectric constant is made 100 kHz because this is a favorable frequency for detecting the state of dispersion of the magnetic body. When the frequency is lower than 100 kHz, it is difficult to make consistent measurements and there is a tendency for dielectric constant differences between magnetic toners to be obscured. In addition, when measurements were performed at 120 kHz, approximately the same values were consistently obtained as at 100 kHz, while there was a tendency at frequencies higher than this for dielectric constant differences between magnetic toners with different properties to be somewhat small. With regard to the use of a temperature of 30° C., this is a temperature that can represent the magnetic toner properties from low to high temperatures for the temperatures assumed within the cartridge during image printing.

By controlling tan δ to a relatively low value, charge leakage is suppressed since the magnetic body is uniformly dispersed to a high degree in the magnetic toner.

That is, by preferably controlling tan δ into the range according to the present invention, the properties accrue of facile magnetic toner particle charging and a suppression of charge leakage, which result, coupled with the previously described effects provided by the first, second, and third inorganic fine particles, in additional improvements in the rapid charging performance.

The dielectric loss tangent of the magnetic toner can be adjusted through, for example, control of the state of magnetic body dispersion.

A low dielectric loss tangent can be obtained through the uniform dispersion of the magnetic body in the magnetic toner. For example, the uniform dispersion of the magnetic body can be promoted by raising the kneading temperature during melt kneading in the magnetic toner production step to lower the viscosity of the kneadate. In addition, when the magnetic body is decreased, the frequency with which aggregates are present within the magnetic toner particle is reduced, setting up a trend toward a uniform dispersion, and due to this a declining trend also occurs for the dielectric loss tangent.

In order, as described above, to bring about a uniform dispersion of the magnetic body to control to a low dielectric loss tangent, the use is preferred of a pulverization method, which has a melt kneading step. While, on the other hand, production methods in aqueous media are also known, these are unsuitable in terms of reducing tan δ into the range described by the present invention. For example, when a magnetic toner particle is produced by a dissolution suspension method or suspension polymerization method, there is a tendency for the dielectric loss tangent to assume large values due to the high probability that the magnetic body will be present in the vicinity of the surface, and it is then difficult to achieve equal to or less than $6.0\times10^{-3}$.

As measured using a constant load extrusion-type capillary rheometer, the softening temperature (Ts) of the magnetic toner is preferably from 60.0° C. to 73.0° C., and its difference (Tm−Ts) from the softening point (Tm) is preferably from 45.0° C. to 57.0° C.

The softening temperature (Ts) and the softening point (Tm) are both indices of the ease of melting of the magnetic toner, and, in alternative terms, the softening temperature can be regarded as the temperature at which the magnetic toner begins to melt and the melting point can be regarded as the temperature at which the magnetic toner has completely melted. In the case of a low fixation temperature, the temperature of the recording medium in the fixing zone formed by a heat-resistant film and a support roller may be 100° C. or less for paper. By exercising control such that even at such temperatures the magnetic toner undergoes softening and the particles are rapidly adhered by pressure, the gaps among the toner particles are extinguished and heat conduction proceeds efficiently, and this is advantageous for fixing.

The softening temperature (Ts) can provide a high degree of control of the ease of softening of the magnetic toner at such low temperatures. When the softening temperature (Ts) is not more than 73.0° C., the magnetic toner readily melts, even under the severe fixing conditions as indicated above, and an excellent fixing may then be carried out. When, however, the softening temperature (Ts) is less than 60.0° C., while this is preferred for low-temperature fixing, it is unsuitable with regard to the storage stability.

The softening temperature (Ts) can be adjusted using the composition of the release agent and the content of low molecular weight polymer in the binder resin. The softening point (Tm) can be adjusted using the content and molecular weight of the high molecular weight polymer.

The low-temperature fixability can be improved by lowering Ts as indicated above, but, on the other hand, it is also important that Tm−Ts be held at a certain magnitude. Tm−Ts is an index that corresponds to the region where the low-temperature fixability and hot offset property are satisfactory, i.e., to the width of the fixing region. According to the results of investigations by the present inventors, a satisfactory fixing region can be secured when Tm −Ts is at least 45.0° C., but either property, i.e., the low-temperature fixability or the hot offset properties, assumes a declining trend when 57.0° C. is exceeded.

The molecular weight distribution of the tetrahydrofuran (THF)-soluble matter of the magnetic toner of the present invention, as measured by gel permeation chromatography (GPC), preferably has a main peak ($M_A$) in the molecular weight region of from 4,000 to 8,000, a subpeak ($M_B$) in the molecular weight region of from 100,000 to 500,000, and a ratio ($S_A/(S_A+S_B)$) of the main peak area ($S_A$) to the total area of the main peak area ($S_A$) and the subpeak area ($S_B$) of at least 70%.

Figure 5:
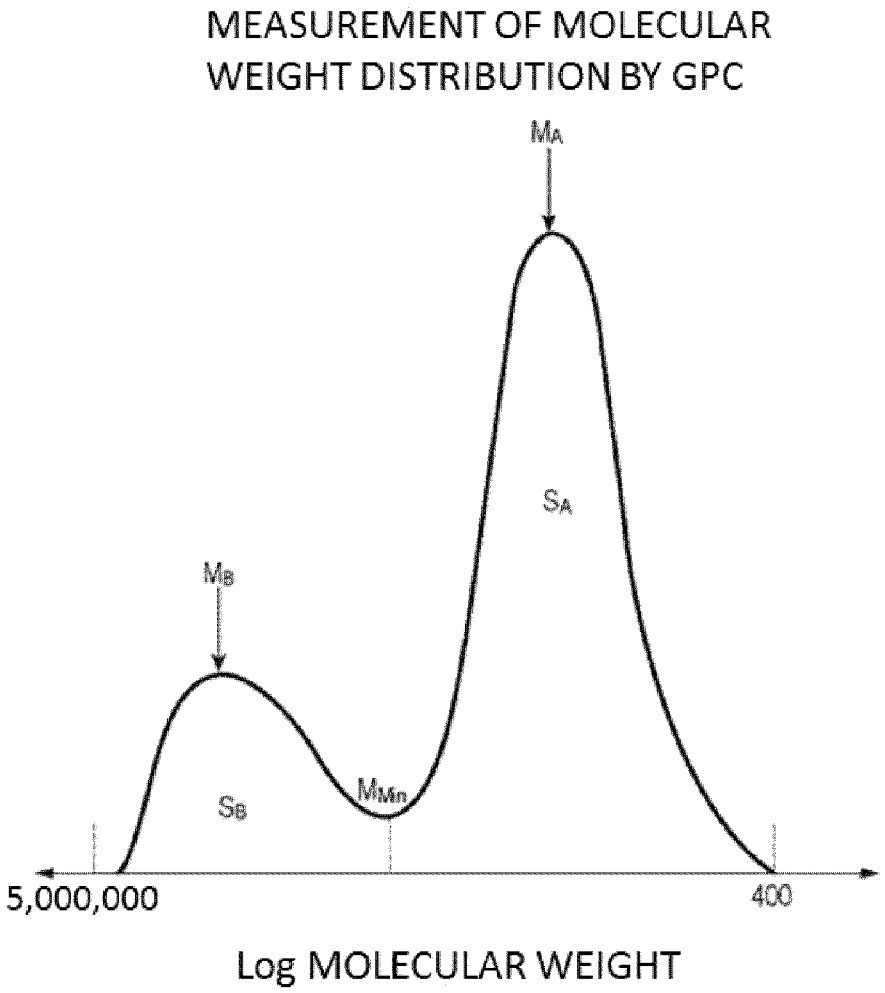
FIG. 5 is a molecular weight distribution curve for a magnetic toner.

Here, as shown in FIG. 5, a minimum value ($M_{Min}$) is present between the main peak ($M_A$) and the subpeak ($M_B$). In addition, $S_A$ refers to the area of the molecular weight distribution curve from a molecular weight of 4,000 to the minimum value ($M_{Min}$), while $S_B$ refers to the area of the molecular weight distribution curve from the minimum value ($M_{Min}$) to a molecular weight of 5,000,000.

Low-temperature fixing can be achieved to a greater degree in the present invention by controlling the main peak molecular weight ($M_A$) to from 4,000 to 10,000. The low-temperature fixability deteriorates when the main peak molecular weight ($M_A$) exceeds 10,000, while the storage stability assumes a deteriorating trend at below 4,000. In addition, an excellent offset resistance can be maintained by having the subpeak molecular weight ($M_B$) be from 100,000 to 500,000. Hot offset is readily produced at less than 100,000, while fixing is readily impaired when 500,000 is exceeded. Here, low-temperature fixing and offset resistance can co-exist in good balance when the ratio ($S_A/(S_A+S_B)$) of the main peak area to the total area of the main peak area ($S_A$) and the subpeak area ($S_B$) is at least 70%, which is thus preferred. The component with a molecular weight of from 5,000 to 10,000, which contributes to low-temperature fixing, tends to diminish at below 70%.

The molecular weight distribution under consideration can be adjusted by using a low molecular weight polymer in combination with a high molecular weight polymer. Here, the "low molecular weight polymer" refers to polymer with a peak molecular weight of approximately 4,000 to 10,000. The "high molecular weight polymer", on the other hand, refers to polymer with a peak molecular weight of approximately 100,000 to 500,000.

The binder resin for the magnetic toner in the present invention can be exemplified by styrenic resins, polyester resins, epoxy resins, and polyurethane resins, but is not particularly limited and the heretofore known resins may be used. Among these, styrenic resin is preferably the major component from the standpoint of the dispersibility of, for example, the magnetic body and the release agent. The major component of the binder resin is defined in the present invention as being at least equal to or greater than 50 mass % in the binder resin.

The styrenic resins preferred for use can be specifically exemplified by styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-dimethylaminoethyl acrylate copolymers, styrene-methyl methacrylate copolymers, styrene-ethyl methacrylate copolymers, styrene-butyl methacrylate copolymers, styrene-dimethylaminoethyl methacrylate copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-maleic acid copolymers, and styrene-maleate ester copolymers. A single one of these may be used or a combination of a plurality may be used.

The glass transition temperature (Tg) of the magnetic toner of the present invention is preferably from 47° C. to 57° C. A glass transition temperature of from 47° C. to 57° C. is preferred because this can provide an improved storage stability and developing performance durability while maintaining an excellent fixability.

The glass transition temperature of a resin or a magnetic toner can be measured based on ASTM D 3418-82 using a differential scanning calorimeter, for example, a DSC-7 from PerkinElmer Inc. or the DSC2920 from TA Instruments Japan Inc.

Viewed in terms of the low-temperature fixability, the magnetic toner of the present invention preferably contains an ester compound as a release agent and the magnetic toner preferably has a maximum endothermic peak at from 50° C. to 80° C. in measurement using a differential scanning calorimeter (DSC).

The ester compound can be exemplified by saturated fatty acid monoesters such as behenyl behenate, palmityl palmitate, stearyl stearate, lignoceryl lignocerate, glycerol tribehenate, and carnauba wax.

More preferably the ester compound is a monofunctional ester compound having from 36 to 48 carbons.

In addition to the monofunctional ester compounds cited above, multifunctional ester compounds, such as most prominently difunctional ester compounds but also tetrafunctional and hexafunctional ester compounds, may also be used as the ester compound. Specific examples are diesters between saturated aliphatic dicarboxylic acids and saturated aliphatic alcohols, e.g., dibehenyl sebacate, distearyl dodecanedioate, and distearyl octadecanedioate; diesters between saturated aliphatic diols and saturated fatty acids, such as nonanediol dibehenate and dodecanediol distearate; triesters between trialcohols and saturated fatty acids, such as glycerol tribehenate and glycerol tristearate; and partial esters between trialcohols and saturated fatty acids, such as glycerol monobehenate and glycerol dibehenate.

However, with such multifunctional ester compounds, bleeding to the magnetic toner surface may readily occur when the hot air current-mediated surface modification process described below is performed, which results in a tendency for the charging performance uniformity and development performance durability to readily decline.

Specific examples of other release agents that can be used in the present invention are petroleum waxes such as paraffin waxes, microcrystalline waxes, and petrolatum, and their derivatives; montan wax and its derivatives; hydrocarbon waxes provided by the Fischer-Tropsch process and their derivatives; polyolefin waxes as typified by polyethylene and polypropylene, and their derivatives; natural waxes such as carnauba wax and candelilla wax, and their derivatives; and ester waxes. The derivatives here include the oxides, block copolymers with vinylic monomers, and graft modifications.

A single one of these release agents may be used or a combination of two or more may be used.

When a release agent is used in the magnetic toner of the present invention, from 0.5 mass parts to 10 mass parts of the release agent is preferably used per 100 mass parts of the binder resin. From 0.5 mass parts to 10 mass parts is preferred for improving the low-temperature fixability without impairing the storage stability of the magnetic toner.

These release agents can be incorporated in the binder resin by, for example, methods in which, at the time of resin production, the resin is dissolved in a solvent, the temperature of the resin solution is raised, and addition and mixing are carried out while stirring, and methods in which addition is carried out during melt-kneading during magnetic toner production.

Viewed from the perspective of facilitating control such that the magnetic toner has a maximum endothermic peak at from 50° C. to 80° C. in measurement with a differential scanning calorimeter (DSC), the maximum endothermic peak temperature for the release agent is preferably from 50° C. to 80° C.

By having the maximum endothermic peak of the magnetic toner in the present invention be at from 50° C. to 80° C., the magnetic toner is then easily plasticized during fixing and the low-temperature fixability is enhanced. It is also preferred because bleed out by the release agent is suppressed, even during long-term storage, while at the same time the developing performance durability is readily maintained.

The magnetic toner more preferably has a maximum endothermic peak at from 50° C. to 75° C.

Measurement of the peak top temperature of the maximum endothermic peak is carried out in the present invention based on ASTM D 3418-82 using a "Q1000" differential scanning calorimeter (TA Instruments). Temperature correction in the instrument detection section is performed using the melting points of indium and zinc, and the amount of heat is corrected using the heat of fusion of indium.

Specifically, approximately 10 mg of the magnetic toner is accurately weighed out and this is introduced into an aluminum pan, and the measurement is run at a ramp rate of 10° C./minute in the measurement temperature range between 30 to 200° C. using an empty aluminum pan as reference. The measurement is carried out by initially raising the temperature to 200° C., then cooling to 30° C., and then reheating. The peak top temperature of the maximum endothermic peak for the magnetic toner is determined from the DSC curve in the 30 to 200° C. temperature range in this second ramp-up process.

The magnetic body incorporated in the magnetic toner in the present invention can be exemplified by iron oxides such as magnetite, maghemite, and ferrite; metals such as iron, cobalt, and nickel; alloys of these metals with metals such as aluminum, copper, magnesium, tin, zinc, beryllium, calcium, manganese, selenium, titanium, tungsten, and vanadium; and mixtures of the preceding.

The number-average particle diameter (D1) of the primary particles of the magnetic body is preferably not greater than 0.50 μm and is more preferably from 0.05 μm to 0.30 μm.

In addition, viewed in terms of facilitating control to the magnetic properties preferred for the magnetic toner in the present invention, the magnetic properties of the magnetic body are preferably controlled to the following for a magnetic field of 79.6 kA/m.

That is, the saturation magnetization (σs) is preferably 40 to 80 $Am^2/kg$ (more preferably 50 to 70 $Am^2/kg$), and the residual magnetization (σr) is preferably 1.5 to 6.5 $Am^2/kg$ and is more preferably 2.0 to 5.5 $Am^2/kg$.

The magnetic toner of the present invention preferably contains from 35 mass % to 50 mass % of the magnetic body and more preferably contains from 40 mass % to 50 mass %. When the magnetic body content in the magnetic toner is less than 35 mass %, the magnetic attraction to the magnet roll within the developing sleeve is reduced and there is a tendency for the fogging to worsen. When, on the other hand, the magnetic body content exceeds 50 mass %, the density may decline due to a decline in the developing performance.

The magnetic body content in the magnetic toner can be measured using, for example, a TGA Q5000IR thermal analyzer from PerkinElmer Inc. With regard to the measurement method, the magnetic toner is heated from normal temperature to 900° C. at a ramp rate of 25° C./minute under a nitrogen atmosphere, and the mass loss from 100 to 750° C. is taken to be the mass of the component from the magnetic toner excluding the magnetic body and the remaining mass is taken to be the amount of the magnetic body.

The magnetic toner of the present invention preferably has, for a magnetic field of 79.6 kA/m, a saturation magnetization (σs) of from 30.0 $Am^2/kg$ to 40.0 $Am^2/kg$ and more preferably from 32.0 $Am^2/kg$ to 38.0 $Am^2/kg$. In addition, the ratio [σr/σs] of the residual magnetization (σr) to the saturation magnetization (σs) is preferably from 0.03 to 0.10 and is more preferably from 0.03 to 0.06.

The saturation magnetization (σs) can be controlled through, for example, the particle diameter, shape, and added elements for the magnetic body.

The residual magnetization (σr) is preferably not more than 3.0 $Am^2/kg$ and is more preferably not more than 2.6 $Am^2/kg$ and is even more preferably not more than 2.4 $Am^2/kg$.

A small σr/σs means a small residual magnetization for the magnetic toner.

In a magnetic single-component developing system, the magnetic toner is captured by or ejected from the developing sleeve through the effect of the multipole magnet resident within the developing sleeve. The ejected magnetic toner (the magnetic toner detached from the developing sleeve) resists magnetic cohesion when σr/σs is small. Since such a magnetic toner resides in a state of low magnetic cohesion when attached to the developing sleeve by the recapture pole and entered into the blade nip region, turn over of the magnetic toner at the blade nip region proceeds efficiently and a rapid charge rise readily occurs.

[σr/σs] can be adjusted into the indicated range by adjusting the particle diameter and shape of the magnetic body incorporated in the magnetic toner and by adjusting the additives that are added during production of the magnetic body. Specifically, through the addition of, for example, silica or phosphorus to the magnetic body, a high σs can be held intact while σr can be brought down. In addition, a smaller surface area for the magnetic body provides a smaller σr, and, with regard to shape, σr is smaller for a spherical shape, which has a smaller magnetic anisotropy than an octahedron. A combination of these makes it possible to achieve a major reduction in σr and thus enables σr/σs to be controlled to equal to or less than 0.10.

The saturation magnetization (σs) and residual magnetization (σr) of the magnetic toner and magnetic body are measured in the present invention at an external magnetic field of 79.6 kA/m at a room temperature of 25° C. using a VSM P-1-10 vibrating magnetometer (Toei Industry Co., Ltd.). The reason for carrying out the measurement at an external magnetic field of 79.6 kA/m is as follows. The magnetic force of the development pole of the magnet roller fixed in the developing sleeve is generally around 79.6 kA/m (1000 oersted). Due to this, the behavior of the magnetic toner in the developing zone can be understood by measuring the residual magnetization at an external magnetic field of 79.6 kA/m.

A charge control agent is preferably added to the magnetic toner of the present invention. A negative-charging toner is preferred in the present invention because the binder resin itself has a high negative chargeability.

For example, organometal complex compounds and chelate compounds are effective as negative-charging charge control agents, and examples thereof are monoazo metal complex compounds, acetylacetone metal complex compounds, and the metal complex compounds of aromatic hydroxycarboxylic acids and aromatic dicarboxylic acids.

Negative-charging charge control agents can be exemplified by Spilon Black TRH, T-77, and T-95 (Hodogaya Chemical Co., Ltd.) and by BONTRON (registered trademark) S-34, S-44, S-54, E-84, E-88, and E-89 (Orient Chemical Industries Co., Ltd.).

A single one of these charge control agents may be used or a combination of two or more may be used. Viewed in terms of the amount of charge on the magnetic toner, the use amount for these charge control agents, expressed per 100 mass parts of the binder resin, is preferably 0.1 to 10.0 mass parts and is more preferably 0.1 to 5.0 mass parts.

The inorganic fine particles fixed to the magnetic toner particle surface are preferably at least one selection from silica fine particles, titania fine particles, and alumina fine particles. Since these inorganic fine particles are similar in terms of hardness and their effect with regard to improving flowability, a uniform charging performance is readily obtained by controlling the state of fixing to the magnetic toner particle surface. Moreover, silica fine particles preferably account for at least 85 mass % of the total amount of the inorganic fine particles present in the magnetic toner. This is because silica fine particles have the best charging characteristics among the inorganic fine particles referenced above and thus support facile expression of the effects of the present invention.

In addition to the inorganic fine particles having a controlled fixing strength as described in the preceding, other organic and inorganic fine particles may be added to the magnetic toner of the present invention. Examples are lubricants such as silica fine particles, fluororesin particles, zinc stearate particles, and polyvinylidene fluoride particles, and abrasives such as cerium oxide particles, silicon carbide particles, and the fine particles of alkaline-earth metal titanate salts and specifically strontium titanate fine particles, barium titanate fine particles, and calcium titanate fine particles. Spacer particles such as silica may also be used in small amounts to the extent that the effects of the present invention are not affected. Among the preceding, silica fine particles are preferred because they provide a substantially enhanced flowability and facilitate the expression of the effects of the present invention.

In order for the fixing strength-controlled inorganic fine particles to impart an excellent flowability to the magnetic toner, their specific surface area as measured by the BET method based on nitrogen adsorption (BET specific surface area) is preferably from 20 $m^2/g$ to 350 $m^2/g$. From 25 $m^2/g$ to 300 $m^2/g$ is more preferred.

This measurement of the specific surface area (BET specific surface area) by the BET method using nitrogen adsorption is carried out based on JIS Z 8830 (2001). A "TriStar 3000 Automatic Specific Surface Area•Pore Distribution Analyzer" (Shimadzu Corporation), which uses a constant-volume gas adsorption procedure as its measurement principle, is used as the measurement instrumentation.

The fixing strength-controlled inorganic fine particles have preferably been subjected to a hydrophobic treatment, and it is particularly preferred that the hydrophobic treatment be carried out so as to provide a degree of hydrophobicity, as measured by the methanol titration test, of preferably at least 40% and more preferably at least 50%.

The method for carrying out the hydrophobic treatment can be exemplified by methods in which the treatment is carried out using, for example, an organosilicon compound, a silicone oil, or a long-chain fatty acid.

The organosilicon compound here can be exemplified by hexamethyldisilazane, trimethylsilane, trimethylethoxysilane, isobutyltrimethoxysilane, trimethylchlorosilane, dimethyldichlorosilane, methyltrichlorosilane, dimethylethoxysilane, dimethyldimethoxysilane, diphenyldiethoxysilane, and hexamethyldisiloxane. A single one of these may be used or a mixture of two or more may be used.

The silicone oil here can be exemplified by dimethylsilicone oils, methylphenylsilicone oils, α-methylstyrene-modified silicone oils, chlorophenylsilicone oils, and fluorine-modified silicone oils.

A $C_{10-22}$ fatty acid is advantageously used for the long-chain fatty acid, and this may be a straight-chain fatty acid or a branched fatty acid. In addition, a saturated fatty acid or an unsaturated fatty acid may be used.

Among the preceding, $C_{10-22}$ straight-chain saturated fatty acids readily provide a uniform treatment of the inorganic fine particle surface and hence are highly preferred.

The straight-chain saturated fatty acid can be exemplified by capric acid, lauric acid, myristic acid, palmitic acid, stearic acid, arachidic acid, and behenic acid.

Silicone oil-treated silica fine particles are preferred among the inorganic fine particles that are used in the present invention. Silica fine particles that have been treated with a silicon compound and a silicone oil are more preferred because this supports a favorable control of the hydrophobicity.

The method for treating silica fine particles with silicone oil can be exemplified by methods in which silicon compound-treated inorganic fine particles are directly mixed with a silicone oil using a mixer such as a Henschel mixer, and by methods in which the silicone oil is sprayed on the inorganic fine particles. Or, a method may be used in which a silicone oil is dissolved or dispersed in a suitable solvent; the inorganic fine particles are subsequently added thereto with mixing; and the solvent is removed.

In order to obtain an excellent hydrophobicity, the amount of treatment with the silicone oil, expressed per 100 mass parts of the silica fine particles, is preferably from 1 mass parts to 40 mass parts and is more preferably from 3 mass parts to 35 mass parts.

Viewed in terms of the balance between the developing performance and the fixing performance, the weight-average particle diameter (D4) of the magnetic toner of the present invention is preferably from 7.0 μm to 12.0 μm. From 7.5 μm to 11.0 μm is more preferred and from 7.5 μm to 10.0 μm is even more preferred.

The average circularity of the magnetic toner of the present invention is preferably at least 0.955 and is more preferably at least 0.957.

Examples of methods for producing the magnetic toner of the present invention are provided herebelow, but this is not intended as a limitation thereto.

The magnetic toner of the present invention may be produced by any known method without particular limitation as long as the production method has a step that can adjust the fixing status of inorganic fine particles and that preferably has a step in which the average circularity can be adjusted.

Such production methods can be favorably exemplified by the following method. First, the binder resin and magnetic body and other optional materials such as a release agent and charge control agent are thoroughly mixed using a mixer such as a Henschel mixer or ball mill. This is followed by melting and kneading using a heated kneader such as a roll, kneader, or extruder to induce miscibilization between the resins.

After cooling and solidification, the obtained melt kneadate is coarsely pulverized, finely pulverized, and classified to obtain magnetic toner particles, and the magnetic toner can then be obtained by the external addition with mixing of an external additive, e.g., inorganic fine particles, to the obtained magnetic toner particles.

The mixer here can be exemplified by the Henschel mixer (Mitsui Mining Co., Ltd.); Supermixer (Kawata Mfg. Co., Ltd.); Ribocone (Okawara Corporation); Nauta mixer, Turbulizer, and Cyclomix (Hosokawa Micron Corporation); Spiral Pin Mixer (Pacific Machinery & Engineering Co., Ltd.); and Loedige Mixer (Matsubo Corporation).

The kneader here can be exemplified by the KRC Kneader (Kurimoto, Ltd.); Buss Ko-Kneader (Buss Corp.); TEM extruder (Toshiba Machine Co., Ltd.); TEX twin-screw kneader (The Japan Steel Works, Ltd.); PCM Kneader (Ikegai Ironworks Corporation); three-roll mills, mixing roll mills, and kneaders (Inoue Manufacturing Co., Ltd.); Kneadex (Mitsui Mining Co., Ltd.); model MS pressure kneader and Kneader-Ruder (Moriyama Mfg. Co., Ltd.); and Banbury mixer (Kobe Steel, Ltd.).

The pulverizer can be exemplified by the Counter Jet Mill, Micron Jet, and Inomizer (Hosokawa Micron Corporation); IDS mill and PJM Jet Mill (Nippon Pneumatic Mfg. Co., Ltd.); Cross Jet Mill (Kurimoto, Ltd.); Ulmax (Nisso Engineering Co., Ltd.); SK Jet-O-Mill (Seishin Enterprise Co., Ltd.); Kryptron (Kawasaki Heavy Industries, Ltd.); Turbo Mill (Turbo Kogyo Co., Ltd.); and Super Rotor (Nisshin Engineering Inc.).

Among the preceding, the average circularity can be controlled by adjusting the exhaust temperature during fine pulverization using a Turbo Mill. A lower exhaust temperature (for example, no more than 40° C.) provides a smaller value for the average circularity while a higher exhaust temperature (for example, around 50° C.) provides a higher value for the average circularity.

The classifier can be exemplified by the Classiel, Micron Classifier, and Spedic Classifier (Seishin Enterprise Co., Ltd.); Turbo Classifier (Nisshin Engineering Inc.); Micron Separator, Turboplex (ATP), and TSP Separator (Hosokawa Micron Corporation); Elbow Jet (Nittetsu Mining Co., Ltd.); Dispersion Separator (Nippon Pneumatic Mfg. Co., Ltd.); and YM Microcut (Yasukawa Shoji Co., Ltd.).

Screening devices that can be used to screen the coarse particles can be exemplified by the Ultrasonic (Koei Sangyo Co., Ltd.), Rezona Sieve and Gyro-Sifter (Tokuju Corporation), Vibrasonic System (Dalton Co., Ltd.), Soniclean (Sintokogio, Ltd.), Turbo Screener (Turbo Kogyo Co., Ltd.), Microsifter (Makino Mfg. Co., Ltd.), and circular vibrating sieves.

To prepare the magnetic toner according to the present invention, the previously described constituent materials of the magnetic toner are thoroughly mixed with a mixer and subsequently thoroughly kneaded using kneader, and, after cooling and solidification, coarse pulverization is carried out followed by fine pulverization and classification to obtain magnetic toner particles. As necessary, the classification step may be followed by surface modification and adjustment of the average circularity of the magnetic toner particles using a surface modification apparatus to obtain the final magnetic toner particles.

After the magnetic toner particles have been obtained, the magnetic toner according to the present invention can be produced by adding the inorganic fine particles and performing an external addition and mixing process, preferably using the mixing process apparatus described below.

A step in the production of a particularly preferred magnetic toner in the present invention can be exemplified by a hot air current process step in which, for example, surface modification of the magnetic toner particle is carried out by instantaneously blowing a high-temperature hot air current onto the magnetic toner particle surface and immediately thereafter cooling the magnetic toner particle with a cold air current.

The modification of the toner particle surface by such a hot air current process step, because it avoids the application of excessive heat to the magnetic toner particle, can provide surface modification of the magnetic toner particle while preventing deterioration of the starting material components and also supports facile adjustment to the average circularity preferred for the present invention.

For example, a surface modification apparatus as shown in FIG. 1 may be used in the hot air current process step for the magnetic toner particle. In the surface modification apparatus shown in FIG. 1, the toner particle (magnetic toner particle) 51 is passed using an autofeeder 52 through a feed nozzle 53 and is fed in a prescribed amount to the surface modification apparatus interior 54. Because the surface modification apparatus interior 54 is suctioned by a blower 59, the toner particles (magnetic toner particles) 51 introduced from the feed nozzle 53 are dispersed in the interior of the apparatus. The magnetic toner particles 51 dispersed in the interior of the apparatus undergo surface modification through the instantaneous application of heat by a hot air current that is introduced from a hot air current introduction port 55. The hot air current is produced here by a heater, but there is no particular limitation on the apparatus as long as it can produce a hot air current sufficient to effect surface modification of the magnetic toner particle.

The temperature of the hot air current is preferably 180 to 400° C. and is more preferably 200 to 350° C. The flow rate of the hot air current is preferably 4 $m^3$/min to 10 $m^3$/min and is more preferably 5 $m^3$/min to 8 $m^3$/min.

The flow rate of the cold air current is preferably 2 $m^3$/min to 6 $m^3$/min and is more preferably 3 $m^3$/min to 5 $m^3$/min.

The blower air flow rate is preferably 10 $m^3$/min to 30 $m^3$/min and is more preferably 12 $m^3$/min to 25 $m^3$/min.

The injection air flow rate is preferably 0.2 $m^3$/min to 3 $m^3$/min and is more preferably 0.5 $m^3$/min to 2 $m^3$/min.

In the surface modification apparatus shown in FIG. 1, the surface-modified toner particle (surface-modified magnetic toner particle) 57 is instantaneously cooled by a cold air current introduced from a cold air current introduction port 56. Liquid nitrogen is used for the cold air current in the present invention, but there is no particular limitation on the means as long as the surface-modified magnetic toner particle 57 can be instantaneously cooled. The temperature of the cold air current is preferably 2 to 15° C. and is more preferably 2 to 10° C. The surface-modified magnetic toner particles 57 are suctioned off by the blower 59 and are collected by a cyclone 58.

This hot air current process step is in particular highly preferred in the present invention from the standpoint of adjusting the fixing status of the third inorganic fine particles. Adjustment of the fixing status of the third inorganic fine particles can be specifically carried out as follows.

The magnetic toner particles are first subjected to the external addition and mixing process with the inorganic fine particles using a mixer as described above to obtain pre-hot air current process magnetic toner particles. The pre-hot air current process magnetic toner particles are subsequently fed to the surface modification apparatus shown in FIG. 1 and, through the execution of the hot air current process as described above, the inorganic fine particles that have been externally added and mixed are strongly fixed by being covered by the binder resin, which has been semi-melted by the hot air current. The magnetic toner particle is preferably subjected to such an external addition and mixing process with silica fine particles and to the hot air current process. This is preferably followed by an additional external addition and mixing with silica fine particles.

At this time the state of fixing of the third inorganic fine particles can be adjusted through the selection of the inorganic fine particles added to the pre-hot air current process magnetic toner particle and adjustment of their amount of addition and also through optimization of the process conditions in the hot air current process.

In particular, execution of the hot air current process is preferred in order to bring the coverage ratio X by the third inorganic fine particles, which is an important characteristic feature of the present invention, to at least 60.0 area %. However, the present invention is not limited to or by this.

An external addition and mixing process apparatus preferred in the present invention is described below.

Figure 2:
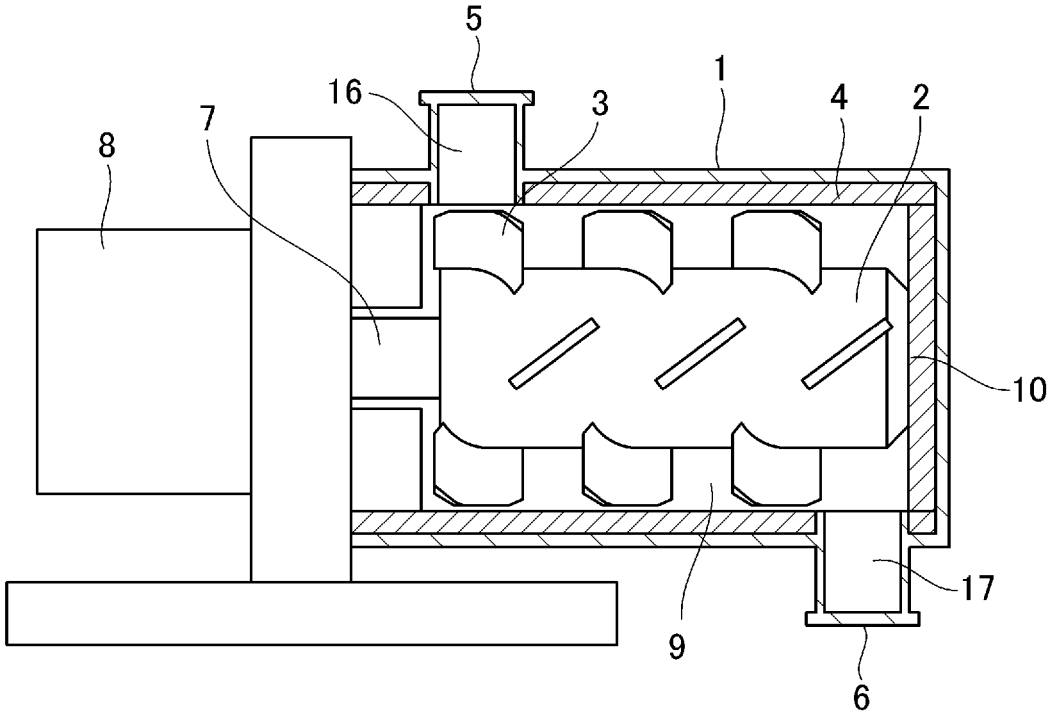
FIG. 2 is a schematic diagram that shows an example of a mixing process apparatus that can be used for the external addition and mixing of inorganic fine particles.

The use of the following external addition and mixing process apparatus as shown in FIG. 2 is strongly preferred in order to have the second inorganic fine particles and first inorganic fine particles satisfy the previously described states when the coverage ratio X by the third inorganic fine particles is the at least 60.0 area % of the present invention.

This mixing process apparatus can bring about fixing of inorganic fine particles to the toner particle surface, while reducing secondary particles to primary particles, because it has a structure that applies shear in a narrow clearance region to the magnetic toner particles and the inorganic fine particles.

As a consequence, the amounts of the first inorganic fine particles and second inorganic fine particles are readily controlled even when the coverage ratio by the third inorganic fine particles is at least 60.0 area % as in the present invention, and this is thus strongly preferred.

Furthermore, as described below, control to a state of inorganic fine particle fixing preferred in the present invention is easily achieved because circulation of the magnetic toner particles and inorganic fine particles in the axial direction of the rotating member is facilitated and because a thorough and uniform mixing is facilitated prior to the development of fixing.

Figure 3:
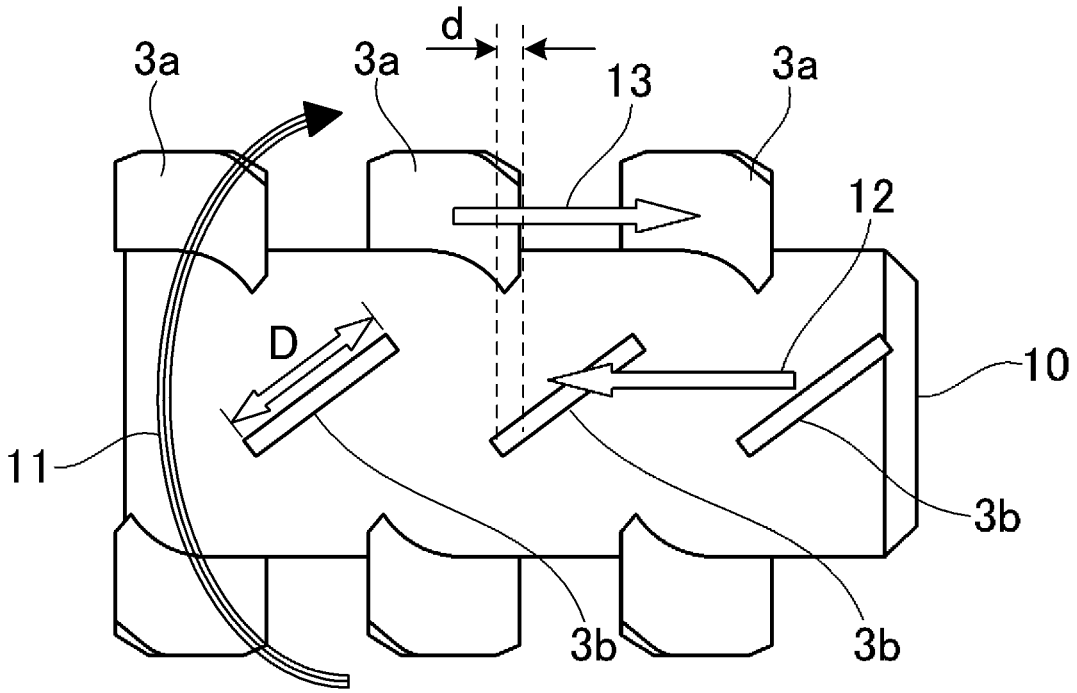
FIG. 3 is a schematic diagram that shows an example of the structure of the stirring member that is used in the mixing process apparatus.

FIG. 3, on the other hand, is a schematic diagram that shows an example of the structure of the stirring member used in the aforementioned mixing process apparatus. The aforementioned external addition and mixing process for inorganic fine particles is described in the following using FIGS. 2 and 3.

This mixing process apparatus that carries out external addition and mixing of the inorganic fine particles has a rotating member 2, on the surface of which at least a plurality of stirring members 3 are disposed; a drive member 8, which drives the rotation of the rotating member 2 (7 shows the central axle); and a main casing 1, which is disposed to have a gap with the stirring members 3.

The gap (clearance) between the inner circumference of the main casing 1 and the stirring member 3 is preferably maintained constant and very small in order to apply a uniform shear to the magnetic toner particles and facilitate the fixing of the inorganic fine particles to the magnetic toner particle surface while reducing secondary particles to primary particles.

The diameter of the inner circumference of the main casing 1 in this apparatus is not more than twice the diameter of the outer circumference of the rotating member 2. An example is shown in FIG. 2 in which the diameter of the inner circumference of the main casing 1 is 1.7-times the diameter of the outer circumference of the rotating member 2 (the diameter of the trunk provided by excluding the stirring members 3 from the rotating member 2). When the diameter of the inner circumference of the main casing 1 is not more than twice the diameter of the outer circumference of the rotating member 2, impact force is satisfactorily applied to the inorganic fine particles that have become secondary particles, since the processing space in which forces act on the magnetic toner particles is suitably limited.

In addition, the clearance is preferably adjusted in conformity to the size of the main casing. Adequate shear can be applied to the inorganic fine particles by making it approximately from 1% to 5% of the diameter of the inner circumference of the main casing 1. Specifically, when the diameter of the inner circumference of the main casing 1 is approximately 130 mm, the clearance is preferably made approximately from 2 mm to 5 mm; when the diameter of the inner circumference of the main casing 1 is about 800 mm, the clearance is preferably made approximately from 10 mm to 30 mm.

In the process of the external addition and mixing of the inorganic fine particles in the present invention, mixing and external addition of the inorganic fine particles to the magnetic toner particle surface are performed using the mixing process apparatus by rotating the rotating member 2 by the drive member 8 and stirring and mixing the magnetic toner particles and inorganic fine particles that have been introduced into the mixing process apparatus.

As shown in FIG. 3, at least a portion of the plurality of stirring members 3 is formed as a forward transport stirring member 3*a* that, accompanying the rotation of the rotating member 2, transports the magnetic toner particles and inorganic fine particles in one direction along the axial direction of the rotating member. In addition, at least a portion of the plurality of stirring members 3 is formed as a back transport stirring member 3*b* that, accompanying the rotation of the rotating member 2, returns the magnetic toner particles and inorganic fine particles in the other direction along the axial direction of the rotating member.

Here, when a raw material inlet port 5 and a product discharge port 6 are disposed at the two ends of the main casing 1, as in FIG. 2, the direction toward the product discharge port 6 from the raw material inlet port 5 (the direction to the right in FIG. 3) is the "forward direction".

That is, as shown in FIG. 3, the face of the forward transport stirring member 3*a* is tilted so as to transport the magnetic toner particles and the inorganic fine particles in the forward direction 13. On the other hand, the face of the stirring member 3*b* is tilted so as to transport the magnetic toner particles and the inorganic fine particles in the back direction 12.

By doing this, the external addition of the inorganic fine particles to the magnetic toner particle surface and mixing are carried out while repeatedly performing transport in the "forward direction 13" and transport in the "back direction 12".

In addition, with regard to the stirring members 3*a* and 3*b*, a plurality of members disposed at intervals in the circumferential direction of the rotating member 2 form a set. In the example shown in FIG. 3, two members at an interval of 180° with each other form a set of the stirring members 3*a*, 3*b* on the rotating member 2, but a larger number of members may form a set, such as three at an interval of 120° or four at an interval of 90°.

In the example shown in FIG. 3, a total of twelve stirring members 3*a*, 3*b* are formed at an equal interval.

Furthermore, D in FIG. 3 indicates the width of a stirring member and d indicates the distance that represents the overlapping portion of a stirring member. In FIG. 3, D is preferably a width that is approximately from 20% to 30% of the length of the rotating member 2, when considered from the standpoint of bringing about an efficient transport of the magnetic toner particles and inorganic fine particles in the forward direction and back direction. FIG. 3 shows an example in which D is 23%. Furthermore, when an extension line is drawn in the perpendicular direction from the position of the end of the stirring member 3*a*, the stirring members 3*a* and 3*b* preferably have a certain overlapping portion d of the stirring member 3*a* with the stirring member 3*b*. This makes it possible to efficiently apply shear to the inorganic fine particles that have become secondary particles. This d is preferably from 10% to 30% of D from the standpoint of the application of shear.

In addition to the shape shown in FIG. 3, the blade shape may be any structure that is capable of transporting the magnetic toner particles in the forward direction and back direction and that is also capable of maintaining the clearance. Specific examples are a shape having a curved surface and a paddle structure in which a distal blade element is connected to the rotating member 2 by a rod-shaped arm.

The present invention will be described in additional detail herebelow with reference to the schematic diagrams of the apparatus shown in FIGS. 2 and 3.

The apparatus shown in FIG. 2 has a rotating member 2, which has at least a plurality of stirring members 3 disposed on its surface; a drive member 8 that drives the rotation of the rotating member 2; and a main casing 1, which is disposed forming a gap with the stirring members 3. It also has a jacket 4, in which a heat transfer medium can flow and which resides on the inside of the main casing 1 and at the end surface 10 of the rotating member 2.

In addition, the apparatus shown in FIG. 2 has a raw material inlet port 5, which is formed on the upper side of the main casing 1 for the purpose of introducing the magnetic toner particles and the inorganic fine particles. It also has a product discharge port 6, which is formed on the lower side of the main casing 1 for the purpose of discharging, from the main casing 1 to the outside, the magnetic toner that has been subjected to the external addition and mixing process.

The apparatus shown in FIG. 2 also has a raw material inlet port inner piece 16 inserted in the raw material inlet port 5 and a product discharge port inner piece 17 inserted in the product discharge port 6.

In the present invention, the raw material inlet port inner piece 16 is first removed from the raw material inlet port 5 and the magnetic toner particles are introduced into the processing space 9 from the raw material inlet port 5. Then, the inorganic fine particles are introduced into the processing space 9 from the raw material inlet port 5 and the raw material inlet port inner piece 16 is inserted. The rotating member 2 is subsequently rotated by the drive member 8 (11 represents the direction of rotation), and the thereby introduced material to be processed is subjected to the external addition and mixing process while being stirred and mixed by the plurality of stirring members 3 disposed on the surface of the rotating member 2.

The sequence of introduction may also be introduction of the inorganic fine particles through the raw material inlet port 5 first and then introduction of the magnetic toner particles through the raw material inlet port 5. In addition, the toner particles and the inorganic fine particles may be mixed in advance using a mixer such as a Henschel mixer and the mixture may thereafter be introduced through the raw material inlet port 5 of the apparatus shown in FIG. 2.

In addition, since the coverage ratio X by the third inorganic fine particles is at least 60.0 area % in the present invention, a two-stage mixing is preferably carried out in which the magnetic toner particles and a portion of the inorganic fine particles are mixed at one time followed by the further addition and mixing of the remaining inorganic fine particles.

This two-stage mixing is preferred because it facilitates control of the fixing of the inorganic fine particles, for example, it facilitates the efficient formation of the second inorganic fine particles, and does so even for a magnetic toner particle surface with a high apparent hardness, which is resistant to inorganic fine particle fixing.

In particular, the use of an external addition and mixing process apparatus as in FIG. 2 is preferred for obtaining the appropriate amount of second inorganic fine particles. However, the present invention is not limited to or by this.

More specifically, with regard to the conditions for the external addition and mixing process, controlling the power of the drive member 8 to from 0.2 W/g to 2.0 W/g is preferred in terms of controlling the fixing as described above.

When the power is lower than 0.2 W/g, it is then difficult to form the second inorganic fine particles and it may not be possible to control to a preferred state of inorganic fine particle fixing for the present invention. On the other hand, at above 2.0 W/g there is a tendency for the inorganic fine particles to end up being excessively embedded.

The processing time is not particularly limited, but is preferably from 3 minutes to 10 minutes.

The rotation rate of the stirring members during external addition and mixing is not particularly limited. For the apparatus shown in FIG. 2 in which the volume of the processing space 9 of the apparatus is $2.0\times10^{-3}$ $m^3$, the rpm of the stirring members—when the shape of the stirring members 3 is as shown in FIG. 3—is preferably from 800 rpm to 3000 rpm. The use of from 800 rpm to 3000 rpm supports facile control to a preferred state of inorganic fine particles fixing for the present invention.

A particularly preferred processing method for the present invention has a pre-mixing step prior to the external addition and mixing process step. Inserting a pre-mixing step achieves a very uniform dispersion of the inorganic fine particles on the magnetic toner particle surface, and as a result control to a preferred state of inorganic fine particles fixing is even more readily achieved.

More specifically, the pre-mixing processing conditions are preferably a power at the drive member 8 of from 0.06 W/g to 0.20 W/g and a processing time of from 0.5 minute to 1.5 minutes. It tends to be difficult to obtain a satisfactorily uniform mixing in the pre-mixing when the loaded power is below 0.06 W/g or the processing time is shorter than 0.5 minute for the pre-mixing processing conditions. When, on the other hand, the loaded power is higher than 0.20 W/g or the processing time is longer than 1.5 minutes for the pre-mixing processing conditions, the inorganic fine particles may end up becoming fixed to the magnetic toner particle surface before a satisfactorily uniform mixing has been achieved.

For the apparatus shown in FIG. 2 in which the volume of the processing space 9 of the apparatus is $2.0\times10^{-3}$ $m^3$, the rpm of the stirring members in the pre-mixing process is preferably from 50 rpm to 500 rpm for the rpm of the stirring members when the shape of the stirring members 3 is as shown in FIG. 3.

After the external addition and mixing process has been finished, the product discharge port inner piece 17 in the product discharge port 6 is removed and the rotating member 2 is rotated by the drive member 8 to discharge the magnetic toner from the product discharge port 6. As necessary, coarse particles and so forth may be separated from the obtained magnetic toner using a screen or sieve, for example, a circular vibrating screen, to obtain the magnetic toner.

Figure 4:
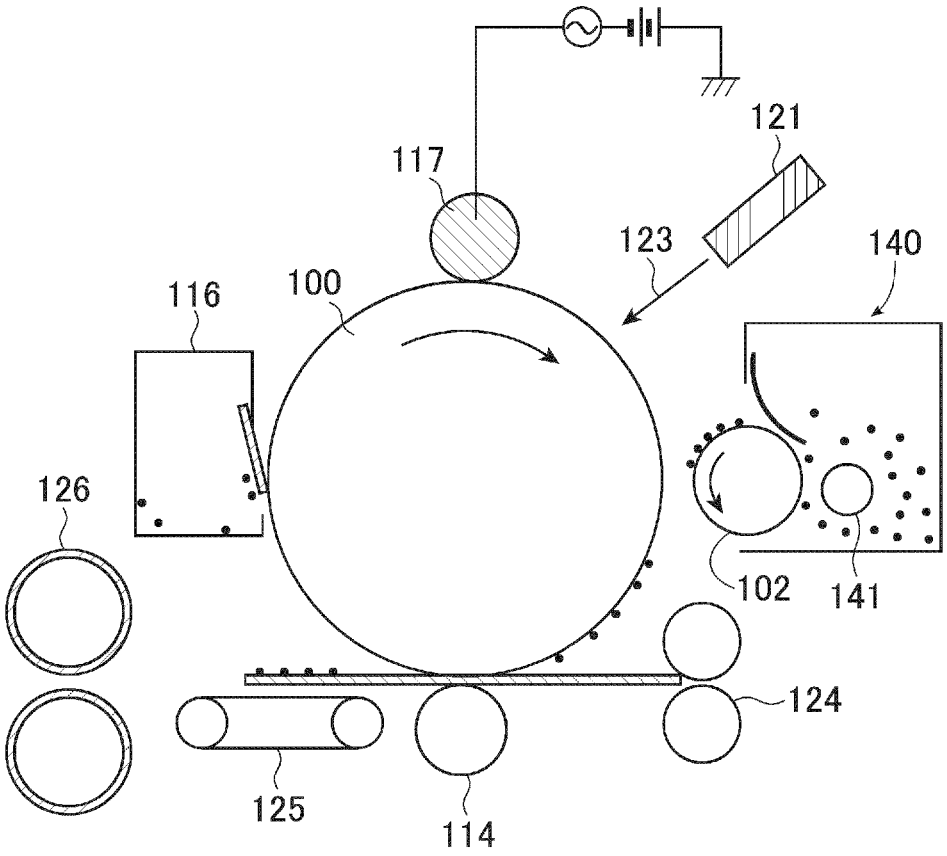
FIG. 4 is a diagram that shows an example of an image-forming apparatus.

An example of an image-forming apparatus that can advantageously use the magnetic toner of the present invention is specifically described below with reference to FIG. 4. In FIG. 4, 100 is an electrostatic latent image-bearing member (also referred to below as a photosensitive member). The following, inter alia, are disposed on its circumference: a charging roller (charging member) 117, a developing device 140, a transfer charging roller 114, a cleaner container 116, a fixing unit 126, and a pick-up roller 124. The developing device 140 has a developing sleeve (developing member) 102, a layer thickness control member 103, and a stirring member 141. The electrostatic latent image-bearing member 100 is charged by the charging roller 117. Photoexposure is performed by irradiating the electrostatic latent image-bearing member 100 with laser light 123 from a laser generator (latent image-forming means, photoexposure apparatus) 121 to form an electrostatic latent image corresponding to the intended image. The electrostatic latent image on the electrostatic latent image-bearing member 100 is developed by the developing device 140 with a single-component toner to provide a toner image, and the toner image is transferred onto a transfer material by the transfer roller 114, which contacts the electrostatic latent image-bearing member with the transfer material interposed therebetween. The toner image-bearing transfer material is conveyed to the fixing unit 126 and fixing on the transfer material is carried out. In addition, the magnetic toner remaining to some extent on the electrostatic latent image-bearing member is scraped off by a cleaning blade and is stored in the cleaner container 116. 124 represents a register roller while 125 represents a transport belt.

The methods for measuring the various properties pertinent to the present invention are described in the following.

<Method of Measuring the Average Circularity of the Magnetic Toner>

The average circularity of the magnetic toner is measured with the "FPIA-3000" (Sysmex Corporation), a flow-type particle image analyzer, using the measurement and analysis conditions from the calibration process.

The specific measurement method is as follows. First, approximately 20 mL of ion-exchanged water from which the solid impurities and so forth have previously been removed is placed in a glass container. To this is added as dispersing agent about 0.2 mL of a dilution prepared by the approximately three-fold (mass) dilution with ion-exchanged water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.). Approximately 0.02 g of the measurement sample is also added and a dispersion treatment is carried out for 2 minutes using an ultrasonic disperser to provide a dispersion for submission to measurement. Cooling is carried out as appropriate during this treatment so as to provide a dispersion temperature of at least 10° C. and no more than 40° C. The ultrasonic disperser used here is a benchtop ultrasonic cleaner/disperser that has an oscillation frequency of 50 kHz and an electrical output of 150 W (for example, a "VS-150" from Velvo-Clear Co., Ltd.); a prescribed amount of ion-exchanged water is introduced into the water tank and approximately 2 mL of the aforementioned Contaminon N is also added to the water tank.

The previously cited flow-type particle image analyzer (fitted with a standard objective lens (10×)) is used for the measurement, and Particle Sheath "PSE-900A" (Sysmex Corporation) is used for the sheath solution. The dispersion prepared according to the procedure described above is introduced into the flow-type particle image analyzer and 3,000 of the magnetic toner are measured according to total count mode in HPF measurement mode. The average circularity of the magnetic toner is determined with the binarization threshold value during particle analysis set at 85% and the analyzed particle diameter limited to a circle-equivalent diameter of from 1.985 μm to less than 39.69 μm.

For this measurement, automatic focal point adjustment is performed prior to the start of the measurement using reference latex particles (for example, a dilution with ion-exchanged water of "RESEARCH AND TEST PARTICLES Latex Microsphere Suspensions 5200A" from Duke Scientific). After this, focal point adjustment is preferably performed every two hours after the start of measurement.

In the present invention, the flow-type particle image analyzer used had been calibrated by the Sysmex Corporation and had been issued a calibration certificate by the Sysmex Corporation. The measurements are carried out under the same measurement and analysis conditions as when the calibration certificate was received, with the exception that the analyzed particle diameter is limited to a circle-equivalent diameter of from 1.985 μm to less than 39.69 μm.

The "FPIA-3000" flow-type particle image analyzer (Sysmex Corporation) uses a measurement principle based on taking a still image of the flowing particles and performing image analysis. The sample added to the sample chamber is delivered by a sample suction syringe into a flat sheath flow cell. The sample delivered into the flat sheath flow is sandwiched by the sheath liquid to form a flat flow. The sample passing through the flat sheath flow cell is exposed to stroboscopic light at an interval of 1/60 second, thus enabling a still image of the flowing particles to be photographed. Moreover, since flat flow is occurring, the photograph is taken under in-focus conditions. The particle image is photographed with a CCD camera; the photographed image is subjected to image processing at an image processing resolution of 512×512 (0.37 μm×0.37 μm per pixel); contour definition is performed on each particle image; and, among other things, the projected area S and the periphery length L are measured on the particle image.

The circle-equivalent diameter and the circularity are then determined using this area S and periphery length L. The circle-equivalent diameter is the diameter of the circle that has the same area as the projected area of the particle image, and the circularity is defined as the value provided by dividing the circumference of the circle determined from the circle-equivalent diameter by the periphery length of the particle's projected image and is calculated using the following formula.

$$\text{circularity}=2\times(\pi\times S)^{1/2}/L$$

The circularity is 1.000 when the particle image is a circle, and the value of the circularity declines as the degree of unevenness in the periphery of the particle image increases. After the circularity of each particle has been calculated, 800 are fractionated out in the circularity range of 0.200 to 1.000; the arithmetic average value of the obtained circularities is calculated; and this value is used as the average circularity.

<Methods for Measuring the Amounts of First and Second Inorganic Fine Particles>

The inorganic fine particles are fixed to the magnetic toner particle at three levels in the present invention, i.e., weak, medium, and strong. The amount of each is obtained by quantitatively determining the total amount of the inorganic fine particles contained in the magnetic toner and quantitating the inorganic fine particles that remain on the magnetic toner particle after inorganic fine particles have been detached from the magnetic toner. In the present invention, the process of detaching the inorganic fine particles is carried out by dispersing the magnetic toner in water and applying shear using a vertical shaker or an ultrasonic disperser. At this time, the inorganic fine particles are classified into the different fixing strengths, e.g., weakly fixed or medium-fixed, using the magnitude of the shear applied to the magnetic toner, and the amounts thereof are obtained. A KM Shaker (Iwaki Industry Co., Ltd.) is used under the conditions given below to detach the first inorganic fine particles, while a VP-050 ultrasonic homogenizer (Taitec Corporation) is used under the conditions given below to detach the second inorganic fine particles. The inorganic fine particle content is quantitatively determined using an Axios x-ray fluorescence analyzer (PANalytical B.V.) and using the "SuperQ ver. 4.0F" (PANalytical B.V.) dedicated software supplied therewith to set the measurement conditions and analyze the measurement data. The measurements are specifically carried out as follows.

(1) Quantitative Determination of the Inorganic Fine Particle Content in the Magnetic Toner Approximately 1 g of the magnetic toner is loaded in a vinyl chloride ring of ring diameter 22 mm×16 mm×5 mm and a sample is fabricated by compression at 100 kgf using a press. The obtained sample is measured using an x-ray fluorescence (XRF) analyzer (Axios) and analysis is performed using the software provided therewith to obtain the net intensity (A) of an element originating with the inorganic fine particles contained by the magnetic toner. For example, the intensity of silicon is used when silica fine particles are used as the inorganic fine particles, while the intensity of titanium is used when titania is used. Then, samples for calibration curve construction are prepared by shaking the inorganic fine particles at an amount of addition of 0.0 mass %, 1.0 mass %, 2.0 mass %, or 3.0 mass % with 100 mass parts of the magnetic toner particles, and, proceeding as described above, a calibration curve is constructed for the inorganic fine particle amount versus the net intensity of the aforementioned element. Prior to the XRF measurement, the sample for calibration curve construction is mixed to uniformity using, for example, a coffee mill. The admixed inorganic fine particles do not influence this determination as long as the admixed inorganic fine particles have a primary particle number-average particle diameter of from 5 nm to 50 nm. The amount of inorganic fine particles in the magnetic toner is determined from the calibration curve and the numerical value of (A).

In this procedure, the inorganic fine particles contained at the magnetic toner surface are first identified by elemental analysis. Here, for example, when silica fine particles are present, the inorganic fine particle content can be elucidated by preparing the samples for calibration curve construction using silica fine particles in the above-described procedure, and when titania fine particles are present the inorganic fine particle content can be elucidated by preparing the samples for calibration curve construction using titania fine particles in the above-described procedure.

(2) Quantitative Determination of the First Inorganic Fine Particles

A dispersion is prepared by introducing 20 g of ion-exchanged water and 0.4 g of the surfactant Contaminon N (Wako Pure Chemical Industries, Ltd.) into a 30 mL glass vial (for example, VCV-30, outer diameter: 35 mm, height: 70 mm, from Nichiden-Rika Glass Co., Ltd.) and thoroughly mixing. Contaminon N (Wako Pure Chemical Industries, Ltd.) is a 10 mass % aqueous solution of a neutral pH 7 detergent for cleaning precision measurement instrumentation and comprises a nonionic surfactant, an anionic surfactant, and an organic builder. A pre-processing dispersion A is prepared by adding 1.5 g of the magnetic toner to this vial and holding at quiescence until the magnetic toner has naturally sedimented. This is followed by shaking under the conditions given below to detach the first inorganic fine particles. The dispersion is then filtered with a vacuum filter to obtain a filter cake A and a filtrate A, and the filter cake A is dried for at least 12 hours in a dryer. The filter paper used in the vacuum filtration is No. 5C from ADVANTEC (particle retention capacity: 1 μm, corresponds to grade 5C in JIS P 3801 (1995)) or a filter paper equivalent thereto.

The material yielded by drying is measured and analyzed using the same x-ray fluorescence analyzer (Axios) as in (1), and the amount of inorganic fine particles detached by the shaking described below is calculated from the calibration curve data obtained in (1) and the difference between the obtained net intensity and the net intensity obtained in (1). That is, the first inorganic fine particles are defined to be the inorganic fine particles that are detached when the dispersion prepared by the addition of the magnetic toner to surfactant-containing ion-exchanged water is shaken under the following conditions.

[Shaker/Conditions]

apparatus: KM Shaker (Iwaki Industry Co., Ltd.)

model: V. SX shaking conditions: shaking for 2 minutes at a speed set to 50 (shaking speed: 46.7 cm/second, 350 back-and-forth excursions in 1 minute, shaking amplitude: 4.0 cm)

(3) Quantitative Determination of the Second Inorganic Fine Particles

After a pre-processing dispersion A has been prepared as described in (2) above, an ultrasonic dispersion process is carried out under the conditions described below to detach the first and second inorganic fine particles contained by the magnetic toner. This is followed by filtration of the dispersion with a vacuum filter, drying, and measurement and analysis with an x-ray fluorescence analyzer (Axios) as described in (2). Here, the second inorganic fine particles were taken to be the inorganic fine particles that were not detached under the shaking conditions in (2), but were detached by the ultrasonic dispersion under the conditions indicated below, while the third inorganic fine particles were taken to be the inorganic fine particles strongly fixed to the degree that they were not removed even by ultrasonic dispersion under the conditions indicated below. The amount of third inorganic fine particles is obtained from the net intensity yielded by x-ray fluorescence analysis and the calibration curve data obtained in (1). The amount of second inorganic fine particles is obtained by subtracting the obtained amount of third inorganic fine particles and the amount of first inorganic fine particles obtained in (2) from the inorganic fine particle content obtained in (1).

Figure 6:
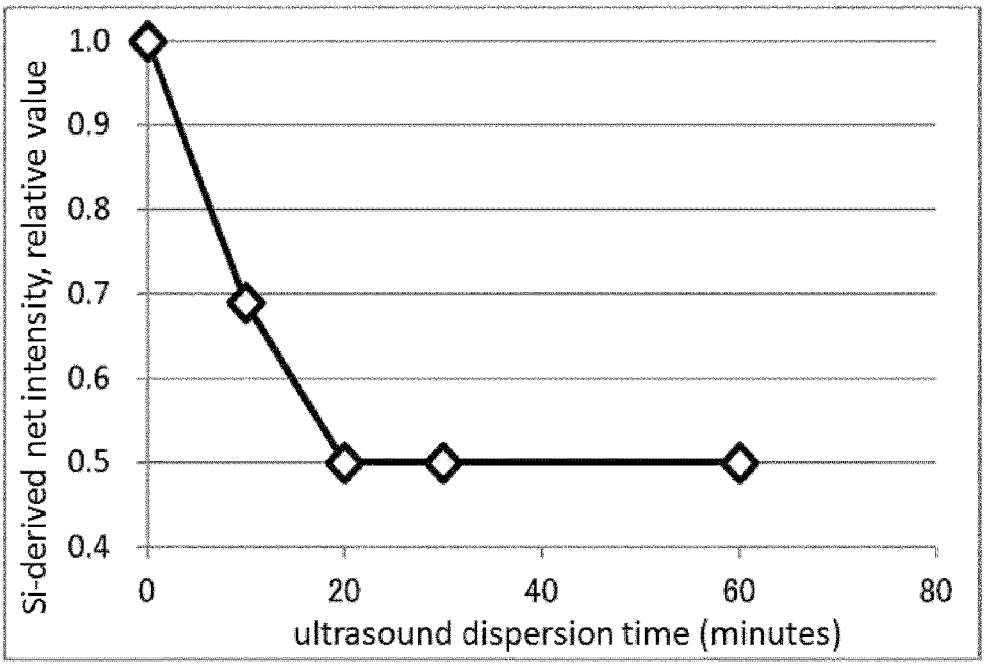
FIG. 6 is a diagram that shows an example of the relationship between the ultrasonic dispersion time and the coverage ratio.

The reason for a 30-minute dispersion in the dispersion conditions is as follows. FIG. 6 shows the relationship between the ultrasonic dispersion time and the net intensity deriving from the inorganic fine particles after ultrasonic dispersion using the ultrasonic homogenizer indicated below, for magnetic toner to which inorganic fine particles have been externally added at the three external addition strengths. The 0-minute dispersion time uses the data after processing by the KM Shaker in (2). According to FIG. 6, detachment of the inorganic fine particles by ultrasonic dispersion proceeds progressively and becomes approximately constant for all external addition strengths after an ultrasonic dispersion for 20 minutes.

[Ultrasonic Dispersion Apparatus/Conditions]

apparatus: VP-050 ultrasonic homogenizer (TAITEC Corporation)

microtip: step-type microtip, 2 mmϕ tip diameter position of the tip of the microtip: center of the glass vial, height of 5 mm from the bottom of the vial ultrasound conditions: 30% intensity (15 W intensity, 120 W/cm$^2$), 30 minutes. The ultrasound is applied here while cooling the vial with ice water to prevent the dispersion from undergoing an increase in temperature.

<The Coverage Ratio X by the Third Inorganic Fine Particles>

The first and second inorganic fine particles are first removed by carrying out dispersion under the ultrasonic dispersion conditions in the quantitative determination (3) of the first and second inorganic fine particles to prepare a sample in which only the third inorganic fine particles are fixed to the magnetic toner particle. The coverage ratio X of the magnetic toner surface by the third inorganic fine particles is then determined proceeding as described below. The coverage ratio X represents the percentage of the magnetic toner particle surface taken by the area covered by the third inorganic fine particles.

Elemental analysis of the surface of the indicated sample is carried out using the following instrumentation under the following conditions.

measurement instrumentation: Quantum 2000 x-ray photoelectron spectroscope (trade name, from Ulvac-Phi, Incorporated)

x-ray source: monochrome Al Kα x-ray setting: 100 μmϕ (25 W (15 kV))

photoelectron take-off angle: 45° neutralization conditions: combination of a neutralization gun and ion gun analysis region: 300×200 μm pass energy: 58.70 eV step size: 1.25 eV analytic software: Multipak (from PHI)

The description here concerns an example in which silica fine particles were used for the third inorganic fine particles. The peaks for C 1c (B. E. 280 to 295 eV), O 1s (B. E. 525 to 540 eV), and Si 2p (B. E. 95 to 113 eV) were used to calculate the quantitative value for the Si atom. The quantitative value obtained here for the element Si is designated as Y1.

Elemental analysis of the silica fine particle itself is then carried out proceeding as for the previously described elemental analysis of the magnetic toner surface and the quantitative value for the element Si thereby obtained is designated as Y2.

The coverage ratio X of the magnetic toner surface by the silica fine particles is defined by the following formula using this Y1 and Y2.

$$\text{coverage ratio } X \text{ (area \%)} = (Y1/Y2) \times 100$$

In order to improve the accuracy of this measurement, measurement of Y1 and Y2 is preferably carried out at least twice. In the determination of the quantitative value Y2, the measurement is carried out using the silica fine particles used for the external addition if these can be obtained.

When titania fine particles (or alumina fine particles) have been selected for the third inorganic fine particles, the coverage ratio X can be similarly determined by determining the aforementioned parameters Y1 and Y2 using the element Ti (or the element Al for alumina fine particles).

Here, when a plurality of inorganic fine particles have been selected for the third inorganic fine particles, for example, when silica fine particles and titania fine particles have been selected, the coverage ratio for each is determined and the inorganic fine particle coverage ratio can then be calculated by summing these.

When the inorganic fine particles are unknown, the third inorganic fine particles are isolated by carrying out the same procedure as in the method for measuring the number-average particle diameter (D1) of the primary particles of the third inorganic fine particles, infra. The obtained third inorganic fine particles are subjected to elemental analysis to identify an atom constituting these inorganic fine particles, and this is made the analytic target. For the first inorganic fine particles and second inorganic fine particles, the analytic targets can also be identified as necessary by isolation and execution of elemental analysis.

<The Method for Measuring the Number-Average Particle Diameter (D1) of the Primary Particles of the First and Second Inorganic Fine Particles>

The number-average particle diameter of the primary particles of the first and second inorganic fine particles is calculated from the image of the inorganic fine particles on the toner surface taken with Hitachi's S-4800 ultrahigh resolution field emission scanning electron microscope (Hitachi High-Technologies Corporation). The conditions for image acquisition with the S-4800 are as follows.

(1) Specimen Preparation (1-1) Preparation of the First Inorganic Fine Particle Sample A filtrate A is obtained by carrying out the same procedure as in the "(2) Quantitative determination of the first inorganic fine particles" above. The filtrate A is transferred to a swing rotor glass tube (50 mL) and separation is performed using a centrifugal separator at 3500 rpm for 30 minutes. After visually checking that the inorganic fine particles and aqueous solution have been well separated, the aqueous solution is removed by decantation. The inorganic fine particles that remain are recovered with, for example, a spatula, and are dried to obtain S-4800 observation sample A.

(1-2) Preparation of the Second Inorganic Fine Particle Sample

A filter cake A is obtained by carrying out the same procedure as in the "(2) Quantitative determination of the first inorganic fine particles" above. After this, a pre-processing dispersion B, in which the filter cake A has been allowed to naturally sediment, is obtained in the same manner as during the preparation of the pre-processing dispersion A in "(2) Quantitative determination of the first inorganic fine particles". The same ultrasonic dispersion process as in the "(3) Quantitative determination of the second inorganic fine particles" above is run on this pre-processing dispersion B to detach the second inorganic fine particles present in the filter cake A. The dispersion is then filtered with a vacuum filter to obtain a filtrate B in which the second inorganic fine particles are dispersed. The filter paper used in the vacuum filtration is No. 5C from ADVANTEC (particle retention capacity: 1 μm, corresponds to grade 5C in JIS P 3801 (1995)) or a filter paper equivalent thereto. Following this, observation sample B is obtained proceeding as above in the preparation of the first inorganic fine particle sample.

(1-3) Preparation and Installation of the Specimen Stub

An electroconductive paste is spread in a thin layer on the specimen stub (15 mm×6 mm aluminum specimen stub) and the thoroughly pulverized observation sample A is placed thereon. Blowing with air is additionally performed to remove excess inorganic fine particles from the specimen stub and carry out thorough drying. The specimen stub is set in the specimen holder and the specimen stub height is adjusted to 36 mm with the specimen height gauge.

(2) Setting the Conditions for Observation with the S-4800

Calculation of the number-average particle diameter of the primary particles of the first and second inorganic fine particles is carried out using the images obtained by backscattered electron image observation with the S-4800. The particle diameter can be measured with excellent accuracy using the backscattered electron image because charge up is less than for the secondary electron image.

Liquid nitrogen is introduced to the brim of the anti-contamination trap attached to the S-4800 housing and standing for 30 minutes is carried out. The "PCSTEM" of the S-4800 is started and flashing is performed (the FE tip, which is the electron source, is cleaned). The acceleration voltage display area in the control panel on the screen is clicked and the [flashing] button is pressed to open the flashing execution dialog. A flashing intensity of 2 is confirmed and execution is carried out. The emission current due to flashing is confirmed to be 20 to 40 μA. The specimen holder is inserted in the specimen chamber of the S-4800 housing. [home] is pressed on the control panel to transfer the specimen holder to the observation position.

The acceleration voltage display area is clicked to open the HV setting dialog and the acceleration voltage is set to [0.8 kV] and the emission current is set to [20 μA]. In the [base] tab of the operation panel, signal selection is set to [SE]; [upper (U)] and [+BSE] are selected for the SE detector; and [L.A. 100] is selected in the selection box to the right of [+BSE] to go into the observation mode using the backscattered electron image. Similarly, in the [base] tab of the operation panel, the probe current of the electron optical system condition block is set to [Normal]; the focus mode is set to [UHR]; and WD is set to [3.0 mm]. The [ON] button in the acceleration voltage display area of the control panel is pushed to apply the acceleration voltage.

(3) Calculation of the Number-Average Particle Diameter (D1) of the Primary Particles of the First and Second Inorganic Fine Particles The magnification is set to 100000× (100 k) by dragging within the magnification indicator area of the control panel. The [COARSE] focus knob on the operation panel is turned and adjustment of the aperture alignment is performed when some degree of focus has been obtained. [Align] is clicked in the control panel and the alignment dialog is displayed and [beam] is selected. The displayed beam is migrated to the center of the concentric circles by turning the STIGMA/ALIGNMENT knobs (X, Y) on the operation panel. [aperture] is then selected and the STIGMA/ALIGNMENT knobs (X, Y) are turned one at a time to adjust so as to stop the motion of the image or minimize the motion. The aperture dialog is closed and focusing is done with the autofocus. This operation is repeated an additional two times to achieve focus.

After this, the average particle diameter is determined by measuring the particle diameter for at least 300 inorganic fine particles. Here, since inorganic fine particles may also be present as aggregates, the major diameter is determined on inorganic fine particles that can be confirmed to be primary particles, and the number-average particle diameter (D1) of the primary particles of the first and second inorganic fine particles is obtained by taking the arithmetic average of the obtained major diameters. In addition, when, for example, the inorganic fine particles are silica fine particles and an object cannot be determined by its appearance to be a silica fine particle, elemental analysis may be carried out as appropriate and the particle diameter is then measured while confirming the detection of silicon as a major component.

<The Method for Measuring the Number-Average Particle Diameter (D1) of the Primary Particles of the Third Inorganic Fine Particles>

A sample B is prepared by carrying out detachment of the first and second inorganic fine particles from the magnetic toner, filtration, and drying using the same procedure as in (3) of "Methods for measuring the amounts of first and second inorganic fine particles".

Tetrahydrofuran is added to sample B with thorough mixing, followed by ultrasonic dispersion for 10 minutes. The magnetic particles are attracted with a neodymium magnet and the supernatant is discarded. This procedure is carried out 5 times to obtain a sample C. Using this procedure, the organic component, e.g., the resin outside the magnetic body, can be almost completely removed. However, since tetrahydrofuran-insoluble matter in the resin may remain present, the residual organic component is combusted by heating the sample C yielded by the preceding procedure to 800° C., thus yielding a sample D. Sample D is observed using the S-4800 by proceeding in the same manner as in (1-3) to (3) of "The method for measuring the number-average particle diameter (D1) of the primary particles of the first and second inorganic fine particles". Sample D contains the magnetic body and the inorganic fine particles that were strongly fixed to the magnetic toner particle. Due to this, the particle diameter is measured on at least 300 inorganic fine particles while checking that they are the inorganic fine particles targeted for measurement by carrying out elemental analysis as appropriate, and the average particle diameter is then determined. Here, since inorganic fine particles may also be present as aggregates, the major diameter is determined on inorganic fine particles that can be confirmed to be primary particles, and the number-average particle diameter (D1) of the primary particles of the third inorganic fine particles is obtained by taking the arithmetic average of the obtained major diameters.

<The Method for Measuring the Softening Temperature (Ts) and Softening Point (Tm) of the Magnetic Toner>

Figure 7:
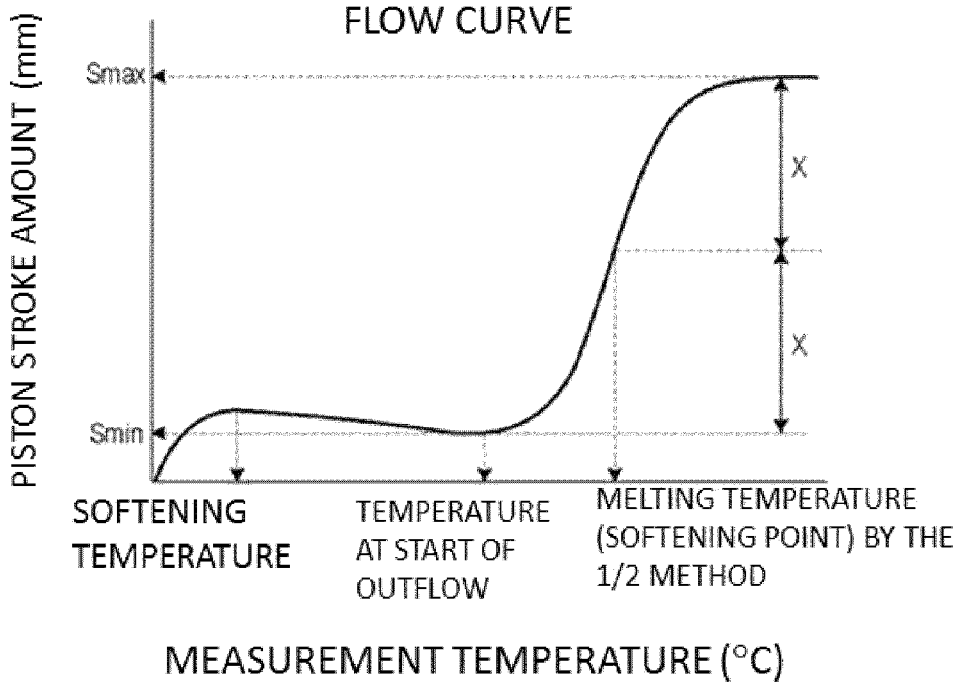
FIG. 7 is a schematic diagram that shows a flow curve for a magnetic toner as measured with a constant load extrusion-type capillary rheometer.

The softening temperature (Ts) and softening point (Tm) of the magnetic toner are measured, according to the manual provided with the instrument, using a "Flowtester CFT-500D Flow Property Evaluation Instrument" (Shimadzu Corporation), a constant load extrusion-type capillary rheometer. With this instrument, while a constant load is applied by a piston from the top of the measurement sample, the measurement sample filled in a cylinder is heated and melted and the melted measurement sample is extruded from a die at the bottom of the cylinder; a flow curve showing the relationship between the piston stroke amount and temperature is obtained from this. A model diagram of the flow curve is given in FIG. 7.

In the present invention, the softening temperature (Ts) is taken to be the temperature at the point at which the piston stroke amount S turns to the declining direction. This decline in the piston stroke amount is due to an expansion in volume caused by melting of the magnetic toner that is the measurement sample.

With regard to the softening point (Tm), on the other hand, the "melting temperature by the ½ method", as described in the manual provided with the "Flowtester CFT-500D Flow Property Evaluation Instrument", is used as the softening point (Tm). The melting temperature by the ½ method is determined as follows. First, letting Smax be the piston stroke amount at the completion of outflow and Smin be the piston stroke amount at the start of outflow, ½ of the difference between Smax and Smin is determined to give the value X (X=(Smax−Smin)/2). The temperature of the flow curve when the piston stroke amount in the flow curve reaches the sum of X and Smin is the melting temperature by the ½ method.

The measurement sample is prepared by subjecting about 1.5 g of the toner to compression molding for approximately 60 seconds at approximately 10 MPa in a 25° C. atmosphere using a tablet compression molder (NT-100H from NPa System Co., Ltd.) to provide a cylindrical shape with a diameter of approximately 8 mm.

The measurement conditions with the Flowtester CFT-500D are as follows.

test mode: rising temperature method
start temperature: 35° C.
saturated temperature: 200° C.
measurement interval: 1.0° C.
ramp rate: 4.0° C./min
piston cross section area: 1.000 $cm^2$
test load (piston load): 10.0 kgf (0.9807 MPa)
preheating time: 300 seconds
diameter of die orifice: 1.0 mm
die length: 1.0 mm The difference between the softening temperature and the softening point is determined by taking the difference (Tm−Ts) between the Ts and Tm provided by this measurement.

<Method for Measuring the Molecular Weight Distribution of the Tetrahydrofuran (THF)-Soluble Matter in the Magnetic Toner>

The molecular weight distribution of the tetrahydrofuran (THF)-soluble matter in the magnetic toner is measured by gel permeation chromatography (GPC) using the following conditions.

The column is stabilized in a heated chamber at 40° C., and tetrahydrofuran (THF) is introduced as solvent at a flow rate of 1 mL per minute into the column at this temperature. For the column, a combination of a plurality of commercially available polystyrene gel columns is favorably used in order to accurately measure the molecular weight range from $10^3$ to $2\times10^6$. An example here is the combination of Shodex GPC KF-801, 802, 803, 804, 805, 806, 807, and 800P from Showa Denko Kabushiki Kaisha. Another example is the combination of TSKgel G1000H($H_{XL}$), G2000H($H_{XL}$), G3000H($H_{XL}$), G4000H($H_{XL}$), G5000H ($H_{XL}$), G6000H($H_{XL}$), G7000H($H_{XL}$), and TSKguard column from Tosoh Corporation. A 7-column train of Shodex KF-801, 802, 803, 804, 805, 806, and 807 from Showa Denko Kabushiki Kaisha is used in the present invention.

On the other hand, the magnetic toner is dispersed and dissolved in THF and thereafter allowed to stand overnight and is then filtered using a sample treatment filter (MyShoriDisk H-25-2 with a pore size of 0.2 to 0.5 μm (Tosoh Corporation)) and the filtrate is used for the sample. 50 to 200 μL of the THF solution of the magnetic toner, which has been adjusted to bring the resin component to 0.5 to 5 mg/mL for the sample concentration, is injected to carry out the measurement. An RI (refractive index) detector is used for the detector.

To measure the molecular weight of the sample, the molecular weight distribution possessed by the sample is calculated from the relationship between the number of counts and the logarithmic value on a calibration curve constructed using several different monodisperse polystyrene standard samples. Standard polystyrene samples with molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ from the Pressure Chemical Company or Tosoh Corporation are used as the standard polystyrene samples used to construct the calibration curve, and standard polystyrene samples at approximately 10 points or more are used.

Here, the main peak is the maximum peak obtained in the molecular weight region of from 4,000 to 8,000 in the obtained molecular weight distribution, and the molecular weight at its peak top is defined as the molecular weight ($M_A$) of the main peak. In addition, the subpeak is the maximum peak obtained in the molecular weight region of from 100,000 to 500,000, and the molecular weight at its peak top is taken to be the molecular weight ($M_B$) of the subpeak. Using the minimum value ($M_{MIn}$) present between the main peak ($M_A$) and the subpeak ($M_B$), $S_A$ is defined as the area of the molecular weight distribution curve from a molecular weight of 400 to the minimum value ($M_{Min}$), and $S_B$ is defined as the area of the molecular weight distribution curve from the minimum value ($M_{Min}$) to a molecular weight of 5,000,000. For $S_A$ and $S_B$, the GPC chart is printed on paper; the chromatogram is cut out; the main peak and subpeak are cut out from one another; and the weights are determined. The ratio (%) of $S_A$ to the total area provided by summing $S_A$ and $S_B$ can be determined using the obtained weights since the weight is proportional to the area. An example of how to determine the $M_A$, $M_B$, $S_A$, and $S_B$ in the GPC chart is given in FIG. 5.

<Methods for Measuring the Glass Transition Temperature (Tg) of the Magnetic Toner and the Peak Temperature of the Endothermic Peak for the Magnetic Toner>

The glass transition temperature (Tg) of the magnetic toner and the peak temperature of the endothermic peak for the magnetic toner are measured based on ASTM D 3418-82 using a "Q1000" differential scanning calorimeter (TA Instruments).

Temperature correction in the instrument detection section is carried out using the melting points of indium and zinc, while the heat of fusion of indium is used to correct the amount of heat.

5.0 mg of the magnetic toner is precisely weighed out for the measurement sample.

This is introduced into an aluminum pan, and, using an empty aluminum pan as the reference, the measurement is performed at normal temperature and normal humidity at a ramp rate of 10° C./min in the measurement temperature range from 30 to 200° C.

The change in the specific heat in the temperature range from 40° C. to 100° C. is obtained in this temperature ramp-up process. Here, the glass transition temperature (Tg) of the magnetic toner is taken to be the intersection between the differential heat curve and the line for the midpoint between the baseline prior to the appearance of the specific heat change and the baseline after the appearance of the specific heat change.

In this measurement, on the other hand, the temperature is raised to 200° C. at a ramp rate of 10° C./min and is then dropped to 30° C. at 10° C./min and is thereafter raised again at a ramp rate of 10° C./min. The maximum endothermic peak is obtained in the temperature range from 40 to 120° C. in this second temperature ramp-up step. The temperature of its peak top is taken to be the temperature of the maximum endothermic peak.

<Method for Measuring the Dielectric Loss Tangent (Tan δ) of the Magnetic Toner>

The dielectric characteristics of the magnetic toner are measured using the following method.

1 g of the magnetic toner is weighed out and subjected to a load of 20 kPa for 1 minute to mold a disk-shaped measurement specimen having a diameter of 25 mm and a thickness of 1.5±0.5 mm. This measurement specimen is mounted in an ARES (TA Instruments, Inc.) that is equipped with a dielectric constant measurement tool (electrodes) that has a diameter of 25 mm. While a load of 250 g/cm$^2$ is being applied at the measurement temperature of 30° C., the complex dielectric constant at 100 kHz and a temperature of 30° C. is measured using a 4284A Precision LCR meter (Hewlett-Packard Company) and the dielectric constant ∈' and the dielectric loss tangent (tan δ) are calculated from the value measured for the complex dielectric constant.

<Method for Measuring the Saturation Magnetization (σs) and the Residual Magnetization (σr) of the Magnetic Toner>

The saturation magnetization (σs) and residual magnetization (σr) of the magnetic body and magnetic toner are measured in the present invention at an external magnetic field of 79.6 kA/m at a room temperature of 25° C. using a VSM P-1-10 vibrating magnetometer (Toei Industry Co., Ltd.).

<Method for Measuring the Weight-Average Particle Diameter (D4) of the Magnetic Toner>

The weight-average particle diameter (D4) of the magnetic toner is determined proceeding as follows. The measurement instrument used is a "Coulter Counter Multisizer 3" (registered trademark, from Beckman Coulter, Inc.), a precision particle size distribution measurement instrument operating on the pore electrical resistance method and equipped with a 100 μm aperture tube. The measurement conditions are set and the measurement data are analyzed using the accompanying dedicated software, i.e., "Beckman Coulter Multisizer 3 Version 3.51" (from Beckman Coulter, Inc.). The measurements are carried at 25,000 channels for the number of effective measurement channels.

The aqueous electrolyte solution used for the measurements is prepared by dissolving special-grade sodium chloride in ion-exchanged water to provide a concentration of about 1 mass % and, for example, "ISOTON II" (from Beckman Coulter, Inc.) can be used.

The dedicated software is configured as follows prior to measurement and analysis.

In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (from Beckman Coulter, Inc.). The threshold value and noise level are automatically set by pressing the "threshold value/noise level measurement button". In addition, the current is set to 1600 μA; the gain is set to 2; the electrolyte is set to ISOTON II; and a check is entered for the "post-measurement aperture tube flush".

In the "setting conversion from pulses to particle diameter" screen of the dedicated software, the bin interval is set to logarithmic particle diameter; the particle diameter bin is set to 256 particle diameter bins; and the particle diameter range is set to 2 μm to 60 μm.

The specific measurement procedure is as follows.

(1) Approximately 200 mL of the above-described aqueous electrolyte solution is introduced into a 250-mL round-bottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture flush" function of the dedicated software.

(2) Approximately 30 mL of the above-described aqueous electrolyte solution is introduced into a 100-mL flatbottom glass beaker. To this is added as dispersing agent about 0.3 mL of a dilution prepared by the approximately three-fold (mass) dilution with ion-exchanged water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.).

(3) An "Ultrasonic Dispersion System Tetora 150" (Nikkaki Bios Co., Ltd.) is prepared; this is an ultrasonic disperser with an electrical output of 120 W and is equipped with two oscillators (oscillation frequency=50 kHz) disposed such that the phases are displaced by 180°. Approximately 3.3 L of ion-exchanged water is introduced into the water tank of this ultrasonic disperser and approximately 2 mL of Contaminon N is added to the water tank.

(4) The beaker described in (2) is set into the beaker holder opening on the ultrasonic disperser and the ultrasonic disperser is started. The height of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of the magnetic toner is added to the aqueous electrolyte solution in small aliquots and dispersion is carried out. The ultrasonic dispersion treatment is continued for an additional 60 seconds. The water temperature in the water tank is controlled as appropriate during ultrasonic dispersion to be at least 10° C. and not more than 40° C.

(6) Using a pipette, the dispersed toner-containing aqueous electrolyte solution prepared in (5) is dripped into the roundbottom beaker set in the sample stand as described in (1) with adjustment to provide a measurement concentration of about 5%. Measurement is then performed until the number of measured particles reaches 50,000.

(7) The measurement data is analyzed by the previously cited software provided with the instrument and the weight-average particle diameter (D4) is calculated. When set to graph/volume % with the software, the "average diameter" on the "analysis/volumetric statistical value (arithmetic average)" screen is the weight-average particle diameter (D4).

EXAMPLES

The present invention is described in additional detail through the examples and comparative examples provided below, but the present invention is in no way restricted to or by these. The % and number of parts in the examples and comparative examples, unless specifically indicated otherwise, are in all instances on a mass basis.

BINDER RESIN PRODUCTION EXAMPLES

Binder Resin L-1 Production Example 300 mass parts of xylene was introduced into a four-neck flask and was heated to 85° C. under reflux and a mixture of 70 mass parts of styrene, 30 mass parts of n-butyl acrylate, and 3.1 mass parts of di-tert-butyl peroxide was added dropwise over 5 hours to obtain a polymer solution. After this polymer solution had been thoroughly mixed under reflux, the organic solvent was removed by distillation to obtain binder resin L-1 (glass transition temperature Tg=53° C., peak molecular weight=6200), which was a low molecular weight styrene-acrylic polymer and is shown in Table 1.

Binder Resins L-2 to L-7 Production Example

Binder resins L-2 to L-7, which are shown in Table 1, were obtained as in the Binder Resin L-1 Production Example, but making appropriate adjustments to the peak molecular weight and Tg by changing the amount of introduction and ratios for the starting monomers and di-tert-butyl peroxide.

Binder Resin H-1 Production Example 180 mass parts of degassed water and 20 mass parts of a 2 mass % aqueous polyvinyl alcohol solution were introduced into a four-neck flask. A liquid mixture of 70 mass parts of styrene, 30 mass parts of n-butyl acrylate, 0.005 mass parts of divinylbenzene, and 0.10 mass parts of 2,2-bis(4,4-di-tert-butylperoxycyclohexyl)propane (10-hour half-life temperature: 92° C.) was thereafter added and stirring was carried out to yield a suspension. After the interior of the flask had been thoroughly replaced with nitrogen, the temperature was raised to 85° C. and polymerization was carried out; after holding for 24 hours, a supplemental addition of 0.1 mass parts of benzoyl peroxide (10-hour half-life temperature: 72° C.) was made and holding was continued for another 12 hours to finish the polymerization of a high molecular weight polymer (H-1). This was followed by thorough mixing under reflux and removal of the organic solvent by distillation to obtain binder resin H-1 (glass transition temperature Tg=53° C., peak molecular weight=301,000), which was a styrene-acrylic resin and is shown in Table 1.

Binder Resins H-2 to H-5 Production Example

Binder resins H-2 to H-5, which are shown in Table 1, were obtained as in the Binder Resin H-1 Production Example, but making appropriate adjustments to the peak molecular weight and Tg by changing the amount of introduction and ratios for the starting monomers and 2,2-bis(4,4-di-tert-butylperoxycyclohexyl)propane.

TABLE 1

| | designation | peak molecular weight | Tg(° C.) |
|---|---|---|---|
| high molecular weight polymer | H-1 | 301000 | 53 |
| | H-2 | 500000 | 53 |
| | H-3 | 102000 | 52 |
| | H-4 | 103000 | 60 |
| | H-5 | 94000 | 68 |
| low molecular weight polymer | L-1 | 6200 | 53 |
| | L-2 | 8000 | 53 |
| | L-3 | 4000 | 52 |
| | L-4 | 6100 | 58 |
| | L-5 | 8000 | 60 |
| | L-6 | 6500 | 66 |
| | L-7 | 8800 | 68 |

Magnetic Body 1 Production Example

The following were mixed in an aqueous solution of ferrous sulfate: a sodium hydroxide solution at 1.1 mol-equivalent with reference to the iron, $SiO_2$ in an amount that provided 0.60 mass % as silicon with reference to the iron, and sodium phosphate in an amount that provided 0.15 mass % as phosphorus with reference to the iron. Proceeding in this manner produced an aqueous solution containing ferrous hydroxide. The pH of the aqueous solution was brought to 8.0 and an oxidation reaction was run at 85° C. while blowing in air to prepare a slurry containing seed crystals.

An aqueous ferrous sulfate solution was then added to this slurry to provide 1.0 equivalent with reference to the amount of the starting alkali (sodium component in the sodium hydroxide) and an oxidation reaction was subsequently run while blowing in air and maintaining the slurry at pH 7.5 to obtain a slurry containing magnetic iron oxide. This slurry was filtered, washed, dried, and ground to obtain a magnetic body 1 that had a number-average primary particle diameter (D1) of 0.21 μm and a saturation magnetization of 66.7 $Am^2/kg$ and residual magnetization of 4.0 $Am^2/kg$ for a magnetic field of 79.6 kA/m (1000 oersted).

Magnetic Body 2 Production Example

An aqueous solution containing ferrous hydroxide was prepared by mixing the following in an aqueous solution of ferrous sulfate: a sodium hydroxide solution at 1.1 mol-equivalent with reference to the iron and $SiO_2$ in an amount that provided 0.60 mass % as silicon with reference to the iron. The pH of the aqueous solution was brought to 8.0 and an oxidation reaction was run at 85° C. while blowing in air to prepare a slurry containing seed crystals.

An aqueous ferrous sulfate solution was then added to this slurry to provide 1.0 equivalent with reference to the amount of the starting alkali (sodium component in the sodium hydroxide) and an oxidation reaction was subsequently run while blowing in air and maintaining the slurry at pH 8.5 to obtain a slurry containing magnetic iron oxide. This slurry was filtered, washed, dried, and ground to obtain amagnetic body 2 that had a number-average primary particle diameter (D1) of 0.22 μm and a saturation magnetization of 66.1 $Am^2/kg$ and residual magnetization of 5.9 $Am^2/kg$ for a magnetic field of 79.6 kA/m (1000 oersted).

Magnetic Body 3 Production Example

An aqueous solution containing ferrous hydroxide was prepared by mixing the following in an aqueous solution of ferrous sulfate: a sodium hydroxide solution at 1.1 mol-equivalent with reference to the iron. The pH of the aqueous solution was brought to 8.0 and an oxidation reaction was run at 85° C. while blowing in air to prepare a slurry containing seed crystals. An aqueous ferrous sulfate solution was then added to this slurry to provide 1.0 equivalent with reference to the amount of the starting alkali (sodium component in the sodium hydroxide) and an oxidation reaction was run while blowing in air and maintaining the slurry at pH 12.8 to obtain a slurry containing magnetic iron oxide. This slurry was filtered, washed, dried, and ground to obtain a magnetic body 3 that had a number-average primary particle diameter (D1) of 0.20 p.m and a saturation magnetization of 65.9 $Am^2/kg$ and residual magnetization of 7.3 $Am^2/kg$ for a magnetic field of 79.6 kA/m (1000 oersted).

Silica Fine Particle Production Example 1

A suspension of silica fine particles was obtained by the dropwise addition of tetramethoxysilane in the presence of methanol, water, and aqueous ammonia while stirring and heating to 35° C. The surface of the silica fine particles was subjected to a hydrophobic treatment by solvent substitution, the addition at room temperature to the obtained dispersion of hexamethyldisilazane as hydrophobing agent, and thereafter heating to 130° C. and carrying out a reaction. The coarse particles were removed by wet passage through a sieve followed by removal of the solvent and drying to obtain silica fine particle 1 (sol-gel silica). Silica fine particle 1 is shown in Table 2.

Silica Fine Particle Production Examples 2 to 8

Silica fine particles 2 to 8 were obtained proceeding as in Silica Fine Particle Production Example 1, but changing the reaction temperature and stirring rate as appropriate. Silica fine particles 2 to 8 are shown in Table 2.

Silica Fine Particle Production Example 9

100 mass parts of a dry silica (BET: 130 $m^2/g$) was treated with 15 mass parts of hexamethyldisilazane and then with 10 mass parts of dimethylsilicone oil to obtain silica fine particle 9. Silica fine particle 9 is shown in Table 2.

Silica Fine Particle Production Examples 10 and 11

Silica fine particles 10 and 11 were obtained in the same manner by carrying out the same surface treatment as for silica fine particle 9, but using starting silica fine particles as indicated below, which had different BET values for the dry silica. Silica fine particles 10 and 11 are shown in Table 2. silica fine particle 10: BET: 200 $m^2/g$ silica fine particle 11: BET: 300 $m^2/g$

TABLE 2

| | number-average particle diameter D1 (nm) | type of silica |
|---|---|---|
| silica fine particle 1 | 110 | sol-gel silica |
| silica fine particle 2 | 150 | sol-gel silica |
| silica fine particle 3 | 70 | sol-gel silica |
| silica fine particle 4 | 60 | sol-gel silica |
| silica fine particle 5 | 180 | sol-gel silica |
| silica fine particle 6 | 50 | sol-gel silica |
| silica fine particle 7 | 200 | sol-gel silica |
| silica fine particle 8 | 300 | sol-gel silica |

TABLE 2-continued

| | number-average particle diameter D1 (nm) | type of silica |
|---|---|---|
| silica fine particle 9 | 20 | fumed silica |
| silica fine particle 10 | 11 | fumed silica |
| silica fine particle 11 | 6 | fumed silica |

Magnetic Toner Particle Production Example 1

| | |
|---|---|
| high molecular weight polymer H-1: | 90 mass parts |
| low molecular weight polymer L-1: | 10 mass parts |
| wax 1 as shown in Table 3: | 5.0 mass parts |
| magnetic body 1: | 95 mass parts |
| T-77 charge control agent (Hodogaya Chemical Co., Ltd.): | 1.0 mass parts |

TABLE 3

| | name | maximum endothermic peak temperature (° C.) |
|---|---|---|
| wax 1 | behenyl behenate | 73.2 |
| wax 2 | palmityl palmitate | 55.2 |
| wax 3 | stearyl stearate | 68.1 |
| wax 4 | lignoceryl lignocerate | 78.5 |
| wax 5 | glycerol tribehenate | 68.5 |
| wax 6 | paraffin wax | 75.2 |
| wax 7 | carnauba wax | 83.6 |
| wax 8 | polyethylene wax | 88.0 |

The starting materials listed above were preliminarily mixed using an FM10C Henschel mixer (Mitsui Miike Chemical Engineering Machinery Co., Ltd.). This was followed by kneading with a twin-screw kneader/extruder (PCM-30, Ikegai Ironworks Corporation) set at a rotation rate of 200 rpm with the set temperature being adjusted to provide a direct temperature in the vicinity of the outlet for the kneaded material of 155° C.

The resulting melt-kneaded material was cooled and the cooled melt-kneaded material was coarsely pulverized with a cutter mill. The resulting coarsely pulverized material was then finely pulverized using a Turbo Mill T-250 (Turbo Kogyo Co., Ltd.) at a feed rate of 20 kg/hr with the air temperature adjusted to provide an exhaust temperature of 40° C. Classification was subsequently performed using a Coanda effect-based multi-grade classifier to obtain a magnetic toner particle having a weight-average particle diameter (D4) of 7.9 μm.

An external addition and mixing process was carried out using the apparatus shown in FIG. 2 on the magnetic toner particle obtained as described above.

In this example an apparatus (NOB-130, Hosokawa Micron Corporation) was used that had a volume for the processing space 9 of the apparatus shown in FIG. 2 of $2.0\times10^{-3}$ $m^3$, and the rated power for the drive member 8 was 5.5 kW and the stirring member 3 had the shape given in FIG. 3. The overlap width d in FIG. 3 between the stirring member 3*a* and the stirring member 3*b* was 0.25D with respect to the maximum width D of the stirring member 3, and the minimum gap between the stirring member 3 and the inner circumference of the main casing 1 was 2.0 mm.

100 mass parts (500 g) of the aforementioned magnetic toner particle and 3.0 mass parts of the silica fine particle 1 referenced in Table 2 were introduced into the apparatus shown in FIG. 2 having the apparatus structure described above.

A pre-mixing was carried out after the introduction of the magnetic toner particles and the silica fine particles in order to uniformly mix the magnetic toner particles and the silica fine particles. The pre-mixing conditions were as follows: a drive member 8 power of 0.1 W/g (drive member 8 rotation rate of 150 rpm) and a processing time of 1 minute.

The external addition and mixing process was carried out once pre-mixing was finished. With regard to the conditions for the external addition and mixing process, the processing time was 5 minutes and the peripheral velocity of the outermost end of the stirring member 3 was adjusted to provide a constant drive member 8 power of 1.6 W/g (drive member 8 rotation rate of 2500 rpm).

A surface modification with the surface modification apparatus shown in FIG. 1 was then run on the magnetic toner particles that had been subjected to the external addition and mixing process with silica fine particle 1. The conditions in all of the surface modifications were as follows: starting material feed rate, all at 2 kg/hr; hot air current flow rate, all at 7 $m^3$/min; and hot air current ejection temperature, all at 300° C. The following were also used: cold air current temperature=4° C., cold air current flow rate=4 $m^3$/min, blower air flow rate=20 $m^3$/min, and injection air flow rate=1 $m^3$/min. This surface modification process yielded a magnetic toner particle 1 that had strongly fixed silica fine particles (third inorganic fine particles) at the surface.

The formulation and surface modification conditions for magnetic toner particle 1 are given in Table 4.

Magnetic Toner Particle Production Examples 2 to 16

Magnetic toner particles 2 to 16 were obtained proceeding as in Magnetic Toner Particle Production Example 1, but changing the magnetic toner formulation, type of silica added before surface modification, amount of its addition, and temperature during surface modification of Magnetic Toner Particle Production Example 1 as shown in Table 4.

The formulation and surface modification conditions for magnetic toner particles 2 to 16 are given in Table 4.

Magnetic Toner Particle Production Examples 17 to 27

Magnetic toner particles 17 to 27 were obtained proceeding as in Magnetic Toner Particle Production Example 1, with the following exceptions: the magnetic toner formulation, type of silica added before surface modification, amount of its addition, and temperature during surface modification in Magnetic Toner Particle Production Example 1 were changed as shown in Table 4; also, kneading was carried out in the kneading step with the set temperature adjusted so that the direct temperature of the kneaded material in the vicinity of the outlet was 145° C.

The formulation and surface modification conditions for magnetic toner particles 17 to 27 are given in Table 4.

Magnetic Toner Particle Production Example 28

Magnetic toner particle 28 was obtained proceeding as in Magnetic Toner Particle Production Example 1, with the following exceptions: the magnetic toner formulation in Magnetic Toner Particle Production Example 1 was changed as shown in Table 4; the surface modification process was run without the addition of silica prior to the surface modification; and kneading was carried out in the kneading step with the set temperature adjusted so that the direct temperature of the kneaded material in the vicinity of the outlet was 145° C.

The formulation and surface modification conditions for magnetic toner particle 28 are given in Table 4.

TABLE 4

| | binder resin | | | | | |
|---|---|---|---|---|---|---|
| | low molecular weight polymer | | high molecular weight polymer | | magnetic body | |
| | designation | amount of addition (mass parts) | designation | amount of addition (mass parts) | magnetic body designation | amount of addition (mass parts) |
| magnetic toner particle 1 | L-1 | 10.0 | H-1 | 90.0 | magnetic body 1 | 95 |
| magnetic toner particle 2 | L-1 | 10.0 | H-1 | 90.0 | magnetic body 1 | 95 |
| magnetic toner particle 3 | L-2 | 10.0 | H-2 | 90.0 | magnetic body 1 | 95 |
| magnetic toner particle 4 | L-3 | 10.0 | H-3 | 90.0 | magnetic body 2 | 90 |
| magnetic toner particle 5 | L-1 | 10.0 | H-1 | 90.0 | magnetic body 3 | 60 |
| magnetic toner particle 6 | L-1 | 10.0 | H-1 | 90.0 | magnetic body 3 | 75 |
| magnetic toner particle 7 | L-1 | 10.0 | H-1 | 90.0 | magnetic body 3 | 75 |
| magnetic toner particle 8 | L-1 | 10.0 | H-1 | 90.0 | magnetic body 3 | 75 |
| magnetic toner particle 9 | L-1 | 10.0 | H-1 | 90.0 | magnetic body 3 | 75 |
| magnetic toner particle 10 | L-1 | 10.0 | H-1 | 90.0 | magnetic body 3 | 75 |
| magnetic toner particle 11 | L-1 | 10.0 | H-1 | 90.0 | magnetic body 3 | 75 |
| magnetic toner particle 12 | L-1 | 10.0 | H-1 | 90.0 | magnetic body 3 | 75 |
| magnetic toner particle 13 | L-1 | 10.0 | H-1 | 90.0 | magnetic body 3 | 75 |
| magnetic toner particle 14 | L-4 | 10.0 | H-1 | 90.0 | magnetic body 3 | 75 |
| magnetic toner particle 15 | L-5 | 10.0 | H-2 | 90.0 | magnetic body 3 | 120 |
| magnetic toner particle 16 | L-5 | 30.0 | H-4 | 70.0 | magnetic body 3 | 130 |
| magnetic toner particle 17 | L-6 | 35.0 | H-4 | 65.0 | magnetic body 3 | 130 |
| magnetic toner particle 18 | L-7 | 45.0 | H-5 | 55.0 | magnetic body 3 | 130 |
| magnetic toner particle 19 | L-7 | 45.0 | H-5 | 55.0 | magnetic body 3 | 130 |
| magnetic toner particle 20 | L-7 | 45.0 | H-5 | 55.0 | magnetic body 3 | 130 |
| magnetic toner particle 21 | L-7 | 45.0 | H-5 | 55.0 | magnetic body 3 | 130 |
| magnetic toner particle 22 | L-7 | 45.0 | H-5 | 55.0 | magnetic body 3 | 130 |

TABLE 4-continued

| | | | | | | |
|---|---|---|---|---|---|---|
| magnetic toner particle 23 | L-7 | 45.0 | H-5 | 55.0 | magnetic body 3 | 130 |
| magnetic toner particle 24 | L-7 | 45.0 | H-5 | 55.0 | magnetic body 3 | 130 |
| magnetic toner particle 25 | L-7 | 45.0 | H-5 | 55.0 | magnetic body 3 | 130 |
| magnetic toner particle 26 | L-7 | 45.0 | H-5 | 55.0 | magnetic body 3 | 130 |
| magnetic toner particle 27 | L-7 | 45.0 | H-5 | 55.0 | magnetic body 3 | 130 |
| magnetic toner particle 28 | L-7 | 45.0 | H-5 | 55.0 | magnetic body 3 | 130 |

| | wax | | silica fine particle added prior to surface modification | | |
|---|---|---|---|---|---|
| | wax designation | amount of addition (mass parts) | designation of silica fine particle | amount of addition (mass parts) | surface modification temperature (° C.) |
| magnetic toner particle 1 | wax 1 | 5.0 | silica fine particle 1 | 3.0 | 300 |
| magnetic toner particle 2 | wax 1 | 5.0 | silica fine particle 2 | 3.0 | 280 |
| magnetic toner particle 3 | wax 1 | 5.0 | silica fine particle 3 | 3.0 | 300 |
| magnetic toner particle 4 | wax 1 | 5.0 | silica fine particle 1 | 3.0 | 300 |
| magnetic toner particle 5 | wax 1 | 5.0 | silica fine particle 4 | 3.0 | 300 |
| magnetic toner particle 6 | wax 2 | 5.0 | silica fine particle 5 | 3.0 | 300 |
| magnetic toner particle 7 | wax 3 | 5.0 | silica fine particle 5 | 3.0 | 300 |
| magnetic toner particle 8 | wax 4 | 5.0 | silica fine particle 6 | 3.0 | 300 |
| magnetic toner particle 9 | wax 5 | 5.0 | silica fine particle 7 | 3.0 | 300 |
| magnetic toner particle 10 | wax 6 | 5.0 | silica fine particle 7 | 3.0 | 300 |
| magnetic toner particle 11 | wax 7 | 5.0 | silica fine particle 7 | 3.0 | 300 |
| magnetic toner particle 12 | wax 8 | 5.0 | silica fine particle 7 | 3.0 | 300 |
| magnetic toner particle 13 | wax 8 | 5.0 | silica fine particle 7 | 3.0 | 300 |
| magnetic toner particle 14 | wax 8 | 5.0 | silica fine particle 8 | 3.0 | 300 |
| magnetic toner particle 15 | wax 8 | 5.0 | silica fine particle 8 | 3.0 | 300 |
| magnetic toner particle 16 | wax 8 | 5.0 | silica fine particle 8 | 3.0 | 300 |
| magnetic toner particle 17 | wax 8 | 5.0 | silica fine particle 8 | 3.0 | 300 |
| magnetic toner particle 18 | wax 8 | 5.0 | silica fine particle 8 | 3.3 | 300 |
| magnetic toner particle 19 | wax 8 | 5.0 | silica fine particle 8 | 3.8 | 300 |
| magnetic toner particle 20 | wax 8 | 5.0 | silica fine particle 8 | 2.9 | 300 |
| magnetic toner particle 21 | wax 8 | 5.0 | silica fine particle 8 | 4.3 | 300 |
| magnetic toner particle 22 | wax 8 | 5.0 | silica fine particle 8 | 2.8 | 300 |
| magnetic toner particle 23 | wax 8 | 5.0 | silica fine particle 8 | 4.8 | 300 |
| magnetic toner particle 24 | wax 8 | 5.0 | silica fine particle 8 | 2.6 | 260 |
| magnetic toner particle 25 | wax 8 | 5.0 | silica fine particle 8 | 1.6 | 300 |
| magnetic toner particle 26 | wax 8 | 5.0 | silica fine particle 8 | 5.3 | 300 |
| magnetic toner particle 27 | wax 8 | 5.0 | silica fine particle 8 | 3.3 | 100 |
| magnetic toner particle 28 | wax 8 | 5.0 | — | — | 300 |

Magnetic Toner Production Example 1

The magnetic toner particle 1 obtained in Magnetic Toner Particle Production Example 1 was subjected to an external addition and mixing process using the apparatus shown in FIG. 2 having the same structure as used in Magnetic Toner Particle Production Example 1.

100 mass parts of magnetic toner particle 1 and 0.60 mass parts of the silica fine particle 10 referenced in Table 2 were introduced into the apparatus shown in FIG. 2.

A pre-mixing was carried out after the introduction of the magnetic toner particles and the silica fine particles in order to uniformly mix the magnetic toner particles and the silica fine particles. The pre-mixing conditions were as follows: a drive member 8 power of 0.10 W/g (drive member 8 rotation rate of 150 rpm) and a processing time of 1 minute.

The external addition and mixing process was carried out once pre-mixing was finished. With regard to the conditions for the external addition and mixing process, the processing time was 5 minutes and the peripheral velocity of the outermost end of the stirring member 3 was adjusted to provide a constant drive member 8 power of 0.60 W/g (drive member 8 rotation rate of 1400 rpm).

Subsequent to this, an additional 0.20 mass parts of silica fine particle 10 (a total of 0.80 mass parts into the magnetic toner particles) was added. An additional treatment was performed for 5 minutes with adjustment of the peripheral velocity of the outermost end of the stirring member 3 so as to provide a constant drive member 8 power of 0.60 W/g (drive member 8 rotation rate of 1400 rpm).

After the external addition and mixing process, the coarse particles and so forth were removed using a circular vibrating screen equipped with a screen having a diameter of 500 mm and an aperture of 75 μm to obtain magnetic toner 1.

The external addition and mixing process conditions for magnetic toner 1 are shown in Table 5.

Table 6 reports the results of the measurements on magnetic toner 1, using the previously described methods, for the amount of weakly fixed silica fine particles (first inorganic fine particles), the amount of medium-fixed silica fine particles (second inorganic fine particles), the coverage ratio X by the strongly fixed silica fine particles (third inorganic fine particles), the dielectric and magnetic properties, and the maximum endothermic peak temperature.

TABLE 5

| | | first-stage external addition conditions | | |
|---|---|---|---|---|
| | magnetic toner particle | silica fine particle | amount of silica fine particle addition (mass parts) | first-stage external addition conditions |
| magnetic toner 1 | magnetic toner particle 1 | silica fine particle 10 | 0.60 | 0.60 W/g(1400 rpm) · 5 min |
| magnetic toner 2 | magnetic toner particle 2 | silica fine particle 11 | 0.60 | 0.60 W/g(1400 rpm) · 5 min |
| magnetic toner 3 | magnetic toner particle 3 | silica fine particle 9 | 0.60 | 0.60 W/g(1400 rpm) · 5 min |
| magnetic toner 4 | magnetic toner particle 4 | silica fine particle 10 | 0.60 | 0.60 W/g(1400 rpm) · 5 min |
| magnetic toner 5 | magnetic toner particle 5 | silica fine particle 10 | 0.60 | 0.60 W/g(1400 rpm) · 5 min |
| magnetic toner 6 | magnetic toner particle 6 | silica fine particle 10 | 0.60 | 0.60 W/g(1400 rpm) · 5 min |
| magnetic toner 7 | magnetic toner particle 7 | silica fine particle 10 | 0.60 | 0.60 W/g(1400 rpm) · 5 min |
| magnetic toner 8 | magnetic toner particle 8 | silica fine particle 10 | 0.60 | 0.60 W/g(1400 rpm) · 5 min |
| magnetic toner 9 | magnetic toner particle 9 | silica fine particle 10 | 0.60 | 0.60 W/g(1400 rpm) · 5 min |
| magnetic toner 10 | magnetic toner particle 10 | silica fine particle 10 | 0.60 | 0.60 W/g(1400 rpm) · 5 min |
| magnetic toner 11 | magnetic toner particle 11 | silica fine particle 10 | 0.60 | 0.60 W/g(1400 rpm) · 5 min |
| magnetic toner 12 | magnetic toner particle 12 | silica fine particle 10 | 0.60 | 0.60 W/g(1400 rpm) · 5 min |
| magnetic toner 13 | magnetic toner particle 13 | silica fine particle 10 | 0.60 | 0.60 W/g(1400 rpm) · 5 min |
| magnetic toner 14 | magnetic toner particle 13 | silica fine particle 10 | 0.60 | 0.60 W/g(1400 rpm) · 5 min |
| magnetic toner 15 | magnetic toner particle 14 | silica fine particle 10 | 0.60 | 0.60 W/g(1400 rpm) · 5 min |
| magnetic toner 16 | magnetic toner particle 15 | silica fine particle 10 | 0.60 | 0.60 W/g(1400 rpm) · 5 min |
| magnetic toner 17 | magnetic toner particle 16 | silica fine particle 10 | 0.60 | 0.60 W/g(1400 rpm) · 5 min |
| magnetic toner 18 | magnetic toner particle 17 | silica fine particle 10 | 0.60 | 0.60 W/g(1400 rpm) · 5 min |
| magnetic toner 19 | magnetic toner particle 18 | silica fine particle 10 | 0.60 | 0.60 W/g(1400 rpm) · 5 min |
| magnetic toner 20 | magnetic toner particle 18 | silica fine particle 10 | 0.80 | 1.20 W/g(1800 rpm) · 5 min |
| magnetic toner 21 | magnetic toner particle 19 | silica fine particle 10 | 0.40 | 0.60 W/g(1400 rpm) · 5 min |
| magnetic toner 22 | magnetic toner particle 20 | silica fine particle 10 | 1.30 | 1.20 W/g(1800 rpm) · 5 min |
| magnetic toner 23 | magnetic toner particle 18 | silica fine particle 10 | 0.60 | 0.60 W/g(1400 rpm) · 5 min |
| magnetic toner 24 | magnetic toner particle 18 | silica fine particle 10 | 0.60 | 1.20 W/g(1800 rpm) · 5 min |
| magnetic toner 25 | magnetic toner particle 21 | silica fine particle 10 | 0.30 | 0.60 W/g(1400 rpm) · 5 min |
| magnetic toner 26 | magnetic toner particle 22 | silica fine particle 10 | 1.30 | 1.20 W/g(1800 rpm) · 5 min |
| magnetic toner 27 | magnetic toner particle 18 | silica fine particle 10 | 0.60 | 0.60 W/g(1400 rpm) · 5 min |
| magnetic toner 28 | magnetic toner particle 18 | silica fine particle 10 | 0.50 | 1.20 W/g(1800 rpm) · 5 min |
| magnetic toner 29 | magnetic toner particle 23 | silica fine particle 10 | 0.20 | 0.60 W/g(1400 rpm) · 5 min |
| magnetic toner 30 | magnetic toner particle 24 | silica fine particle 10 | 1.50 | 1.20 W/g(1800 rpm) · 5 min |
| magnetic toner 31 | magnetic toner particle 18 | silica fine particle 10 | 0.60 | 0.60 W/g(1400 rpm) · 5 min |

| | | second-stage external addition conditions | | |
|---|---|---|---|---|
| | magnetic toner particle | silica fine particle | amount of silica fine particle addition (mass parts) | second-stage external addition conditions |
| magnetic toner 1 | magnetic toner particle 1 | silica fine particle 10 | 0.20 | 0.60 W/g(1400 rpm) · 5 min |
| magnetic toner 2 | magnetic toner particle 2 | silica fine particle 11 | 0.20 | 0.60 W/g(1400 rpm) · 5 min |
| magnetic toner 3 | magnetic toner particle 3 | silica fine particle 9 | 0.20 | 0.60 W/g(1400 rpm) · 5 min |
| magnetic toner 4 | magnetic toner particle 4 | silica fine particle 10 | 0.20 | 0.60 W/g(1400 rpm) · 5 min |
| magnetic toner 5 | magnetic toner particle 5 | silica fine particle 10 | 0.20 | 0.60 W/g(1400 rpm) · 5 min |
| magnetic toner 6 | magnetic toner particle 6 | silica fine particle 10 | 0.20 | 0.60 W/g(1400 rpm) · 5 min |
| magnetic toner 7 | magnetic toner particle 7 | silica fine particle 10 | 0.20 | 0.60 W/g(1400 rpm) · 5 min |
| magnetic toner 8 | magnetic toner particle 8 | silica fine particle 10 | 0.20 | 0.60 W/g(1400 rpm) · 5 min |
| magnetic toner 9 | magnetic toner particle 9 | silica fine particle 10 | 0.20 | 0.60 W/g(1400 rpm) · 5 min |
| magnetic toner 10 | magnetic toner particle 10 | silica fine particle 10 | 0.20 | 0.60 W/g(1400 rpm) · 5 min |
| magnetic toner 11 | magnetic toner particle 11 | silica fine particle 10 | 0.20 | 0.60 W/g(1400 rpm) · 5 min |
| magnetic toner 12 | magnetic toner particle 12 | silica fine particle 10 | 0.20 | 0.60 W/g(1400 rpm) · 5 min |
| magnetic toner 13 | magnetic toner particle 13 | silica fine particle 10 | 0.20 | 0.60 W/g(1400 rpm) · 5 min |
| magnetic toner 14 | magnetic toner particle 13 | silica fine particle 10 | 0.20 | 0.60 W/g(1400 rpm) · 5 min |
| magnetic toner 15 | magnetic toner particle 14 | silica fine particle 10 | 0.20 | 0.60 W/g(1400 rpm) · 5 min |
| magnetic toner 16 | magnetic toner particle 15 | silica fine particle 10 | 0.20 | 0.60 W/g(1400 rpm) · 5 min |
| magnetic toner 17 | magnetic toner particle 16 | silica fine particle 10 | 0.20 | 0.60 W/g(1400 rpm) · 5 min |
| magnetic toner 18 | magnetic toner particle 17 | silica fine particle 10 | 0.20 | 0.60 W/g(1400 rpm) · 5 min |
| magnetic toner 19 | magnetic toner particle 18 | silica fine particle 10 | 0.20 | 0.60 W/g(1400 rpm) · 5 min |
| magnetic toner 20 | magnetic toner particle 18 | silica fine particle 10 | 0.10 | 0.60 W/g(1400 rpm) · 5 min |
| magnetic toner 21 | magnetic toner particle 19 | silica fine particle 10 | 0.13 | 0.60 W/g(1400 rpm) · 5 min |
| magnetic toner 22 | magnetic toner particle 20 | silica fine particle 10 | 0.20 | 0.60 W/g(1400 rpm) · 5 min |
| magnetic toner 23 | magnetic toner particle 18 | silica fine particle 10 | 0.28 | 0.60 W/g(1400 rpm) · 5 min |
| magnetic toner 24 | magnetic toner particle 18 | silica fine particle 10 | 0.12 | 0.60 W/g(1400 rpm) · 5 min |
| magnetic toner 25 | magnetic toner particle 21 | silica fine particle 10 | 0.09 | 0.60 W/g(1400 rpm) · 5 min |
| magnetic toner 26 | magnetic toner particle 22 | silica fine particle 10 | 0.30 | 0.60 W/g(1400 rpm) · 5 min |
| magnetic toner 27 | magnetic toner particle 18 | silica fine particle 10 | 0.27 | 0.60 W/g(1400 rpm) · 5 min |
| magnetic toner 28 | magnetic toner particle 18 | silica fine particle 10 | 0.10 | 0.60 W/g(1400 rpm) · 5 min |
| magnetic toner 29 | magnetic toner particle 23 | silica fine particle 10 | 0.10 | 0.60 W/g(1400 rpm) · 5 min |
| magnetic toner 30 | magnetic toner particle 24 | silica fine particle 10 | 0.30 | 0.60 W/g(1400 rpm) · 5 min |
| magnetic toner 31 | magnetic toner particle 18 | silica fine particle 10 | 0.30 | 0.60 W/g(1400 rpm) · 5 min |

TABLE 5-continued

| | | first-stage external addition conditions | | |
|---|---|---|---|---|
| | magnetic toner particle | silica fine particle | amount of silica fine particle addition (mass parts) | first-stage external addition conditions |
| comparative magnetic toner 1 | magnetic toner particle 25 | silica fine particle 10 | 0.60 | 0.60 W/g(1400 rpm) · 5 min |
| comparative magnetic toner 2 | magnetic toner particle 26 | silica fine particle 10 | 0.60 | 0.60 W/g(1400 rpm) · 5 min |
| comparative magnetic toner 3 | magnetic toner particle 18 | silica fine particle 10 | 0.70 | 1.60 W/g(2500 rpm) · 11 min |
| comparative magnetic toner 4 | magnetic toner particle 18 | silica fine particle 10 | 0.40 | 1.60 W/g(2500 rpm) · 15 min |
| comparative magnetic toner 5 | magnetic toner particle 18 | silica fine particle 10 | 0.70 | 1.60 W/g(2500 rpm) · 15 min |
| comparative magnetic toner 6 | magnetic toner particle 27 | silica fine particle 10 | 0.60 | 0.60 W/g(1400 rpm) · 5 min |
| comparative magnetic toner 7 | magnetic toner particle 18 | silica fine particle 10 | 15.00 | 3.30 W/g(4000 rpm) · 15 min |
| comparative magnetic toner 8 | magnetic toner particle 18 | silica fine particle 10 | 0.60 | 3.30 W/g(4000 rpm) · 15 min |
| comparative magnetic toner 9 | magnetic toner particle 18 | silica fine particle 1 | 0.50 | 18.0 W/g(18000 rpm) · 0.5 min |
| comparative magnetic toner 10 | magnetic toner particle 18 | silica fine particle 1 | 0.50 | 18.0 W/g(18000 rpm) · 0.5 min |
| comparative magnetic toner 11 | magnetic toner particle 18 | silica fine particle 1 | 0.60 | 0.30 W/g(1000 rpm) · 20 min |
| comparativ e magnetic toner 12 | magnetic toner particle 18 | silica fine particle 1<br>silica fine particle 6<br>silica fine particle 10 | 1.80<br>0.50<br>1.00 | 0.70 W/g(1500 rpm) · 15 min |
| comparative magnetic toner 13 | magnetic toner particle 18 | silica fine particle 10 | 0.60 | 0.7 0W/g(1500 rpm) · 15 min |
| comparative magnetic toner 14 | magnetic toner particle 28 | silica fine particle 10 | 0.60 | 0.60 W/g(1400 rpm) · 5 min |

| | | second-stage external addition conditions | | |
|---|---|---|---|---|
| | magnetic toner particle | silica fine particle | amount of silica fine particle addition (mass parts) | second-stage external addition conditions |
| comparative magnetic toner 1 | magnetic toner particle 25 | silica fine particle 10 | 0.20 | 0.60 W/g(1400 rpm) · 5 min |
| comparative magnetic toner 2 | magnetic toner particle 26 | silica fine particle 10 | 0.20 | 0.60 W/g(1400 rpm) · 5 min |
| comparative magnetic toner 3 | magnetic toner particle 18 | silica fine particle 10 | 0.10 | 0.60 W/g(1400 rpm) · 5 min |
| comparative magnetic toner 4 | magnetic toner particle 18 | silica fine particle 10 | 0.05 | 0.60 W/g(1400 rpm) · 5 min |
| comparative magnetic toner 5 | magnetic toner particle 18 | silica fine particle 10 | 0.30 | 0.60 W/g(1400 rpm) · 5 min |
| comparative magnetic toner 6 | magnetic toner particle 27 | silica fine particle 10 | 0.20 | 0.60 W/g(1400 rpm) · 5 min |
| comparative magnetic toner 7 | magnetic toner particle 18 | silica fine particle 1 | 0.84 | 1.30 W/g(2000 rpm) · 5 min |
| comparative magnetic toner 8 | magnetic toner particle 18 | silica fine particle 1 | 0.20 | 1.30 W/g(2000 rpm) · 5 min |
| comparative magnetic toner 9 | magnetic toner particle 18 | silica fine particle 9 | 2.00 | Henschel mixer (35 m/s) · 5 min |
| comparative magnetic toner 10 | magnetic toner particle 18 | silica fine particle 9 | 0.30 | Henschel mixer (35 m/s) · 5 min |
| comparative magnetic toner 11 | magnetic toner particle 18 | — | — | — |
| comparative magnetic toner 12 | magnetic toner particle 18 | silica fine particle 1 | 0.20 | Henschel mixer (15 m/s) · 15 min |
| comparative magnetic toner 13 | magnetic toner particle 18 | silica fine particle 1 | 0.20 | Henschel mixer (15 m/s) · 15 min |
| comparative magnetic toner 14 | magnetic toner particle 28 | silica fine particle 10 | 0.20 | 0.60 W/g(1400 rpm) · 5 min |

Magnetic Toner Production Examples 2 to 31

Magnetic toners 2 to 31 were obtained proceeding as for magnetic toner 1, but using the formulations, e.g., the binder resin and magnetic body used, shown in Table 4 and changing the external addition and mixing conditions as shown in Table 5. The properties of magnetic toners 2 to 31 are given in Table 6.

Comparative Magnetic Toner Production Examples 1 to 14

Comparative magnetic toners 1 to 14 were obtained proceeding as for magnetic toner 1, but using the formulations, e.g., the binder resin and magnetic body used, shown in Table 4 and changing the external addition and mixing conditions as shown in Table 5. The properties of comparative magnetic toners 1 to 14 are given in Table 6. With regard to comparative magnetic toners 9, 10, 12, and 13, a Henschel mixer was used as the second-stage external addition and mixing process apparatus and was used under the conditions given in Table 5. The second-stage external addition and mixing was not carried out in the case of comparative magnetic toner 11.

TABLE 6

| | amount of weakly fixed silica fine particles (mass parts) | ratio of the medium-fixed silica fine particles to the amount of weakly fixed silica fine particles | coverage ratio X by the strongly fixed silica fine particles | particle diameter ratio of the silica fine particles (strongly fixed/weakly fixed) |
|---|---|---|---|---|
| magnetic toner 1 | 0.21 | 2.81 | 72.0 | 10 |
| magnetic toner 2 | 0.21 | 2.81 | 71.0 | 25 |
| magnetic toner 3 | 0.20 | 3.00 | 70.5 | 4 |
| magnetic toner 4 | 0.23 | 2.48 | 71.8 | 10 |
| magnetic toner 5 | 0.22 | 2.64 | 71.9 | 5 |
| magnetic toner 6 | 0.24 | 2.33 | 71.9 | 16 |
| magnetic toner 7 | 0.22 | 2.64 | 72.0 | 16 |
| magnetic toner 8 | 0.21 | 2.81 | 71.9 | 5 |
| magnetic toner 9 | 0.23 | 2.48 | 71.9 | 18 |
| magnetic toner 10 | 0.22 | 2.64 | 71.9 | 18 |
| magnetic toner 11 | 0.24 | 2.33 | 72.2 | 18 |
| magnetic toner 12 | 0.20 | 3.00 | 71.9 | 18 |
| magnetic toner 13 | 0.21 | 2.81 | 71.9 | 18 |
| magnetic toner 14 | 0.22 | 2.64 | 71.9 | 0.6 |
| magnetic toner 15 | 0.24 | 2.33 | 71.9 | 0.4 |
| magnetic toner 16 | 0.22 | 2.64 | 71.8 | 0.4 |
| magnetic toner 17 | 0.23 | 2.48 | 71.9 | 0.4 |
| magnetic toner 18 | 0.24 | 2.33 | 71.9 | 0.4 |
| magnetic toner 19 | 0.21 | 2.81 | 72.0 | 0.4 |
| magnetic toner 20 | 0.15 | 5.00 | 71.9 | 0.4 |
| magnetic toner 21 | 0.15 | 2.50 | 80.0 | 0.4 |
| magnetic toner 22 | 0.25 | 5.00 | 65.0 | 0.4 |
| magnetic toner 23 | 0.25 | 2.52 | 71.9 | 0.4 |
| magnetic toner 24 | 0.12 | 5.00 | 71.9 | 0.4 |
| magnetic toner 25 | 0.12 | 2.21 | 85.0 | 0.4 |
| magnetic toner 26 | 0.27 | 4.93 | 63.0 | 0.4 |
| magnetic toner 27 | 0.27 | 2.22 | 72.1 | 0.4 |
| magnetic toner 28 | 0.10 | 5.00 | 72.0 | 0.4 |
| magnetic toner 29 | 0.10 | 2.00 | 90.0 | 0.4 |
| magnetic toner 30 | 0.30 | 5.00 | 60.0 | 0.4 |
| magnetic toner 31 | 0.30 | 2.00 | 72.0 | 0.4 |

| | average circularity | softening temperature (Ts) | softening point (Tm) − softening temperature (Ts) | GPC; main peak (MA) | GPC; subpeak (MB) | main peak area ratio; SA/(SA + SB) |
|---|---|---|---|---|---|---|
| magnetic toner 1 | 0.960 | 65.5 | 50.0 | 6200 | 301000 | 90% |
| magnetic toner 2 | 0.957 | 65.5 | 50.0 | 6200 | 301000 | 90% |
| magnetic toner 3 | 0.959 | 65.5 | 50.0 | 8000 | 500000 | 90% |
| magnetic toner 4 | 0.965 | 65.5 | 50.0 | 4000 | 100000 | 90% |
| magnetic toner 5 | 0.957 | 65.5 | 50.0 | 6200 | 301000 | 90% |
| magnetic toner 6 | 0.957 | 65.5 | 50.0 | 6200 | 301000 | 90% |
| magnetic toner 7 | 0.958 | 65.5 | 50.0 | 6200 | 301000 | 90% |
| magnetic toner 8 | 0.957 | 65.5 | 50.0 | 6200 | 301000 | 90% |
| magnetic toner 9 | 0.958 | 67.2 | 48.0 | 6200 | 301000 | 90% |
| magnetic toner 10 | 0.958 | 68.0 | 47.0 | 6200 | 301000 | 90% |
| magnetic toner 11 | 0.958 | 68.3 | 46.7 | 6200 | 301000 | 90% |
| magnetic toner 12 | 0.959 | 69.0 | 46.5 | 6200 | 301000 | 90% |
| magnetic toner 13 | 0.958 | 71.0 | 46.0 | 6200 | 301000 | 90% |
| magnetic toner 14 | 0.957 | 71.0 | 46.0 | 6200 | 301000 | 90% |
| magnetic toner 15 | 0.958 | 71.5 | 45.5 | 6200 | 301000 | 90% |
| magnetic toner 16 | 0.957 | 72.0 | 45.2 | 8000 | 500000 | 90% |
| magnetic toner 17 | 0.957 | 72.0 | 45.1 | 8000 | 103000 | 70% |
| magnetic toner 18 | 0.957 | 73.0 | 45.0 | 6500 | 103000 | 65% |
| magnetic toner 19 | 0.958 | 74.0 | 44.5 | 8800 | 94000 | 55% |
| magnetic toner 20 | 0.960 | 74.0 | 44.5 | 8800 | 94000 | 55% |

TABLE 6-continued

| | | | | | | |
|---|---|---|---|---|---|---|
| magnetic toner 21 | 0.960 | 74.0 | 44.5 | 8800 | 94000 | 55% |
| magnetic toner 22 | 0.960 | 74.0 | 44.5 | 8800 | 94000 | 55% |
| magnetic toner 23 | 0.960 | 74.0 | 44.5 | 8800 | 94000 | 55% |
| magnetic toner 24 | 0.960 | 74.0 | 44.5 | 8800 | 94000 | 55% |
| magnetic toner 25 | 0.960 | 74.0 | 44.5 | 8800 | 94000 | 55% |
| magnetic toner 26 | 0.960 | 74.0 | 44.5 | 8800 | 94000 | 55% |
| magnetic toner 27 | 0.960 | 74.0 | 44.5 | 8800 | 94000 | 55% |
| magnetic toner 28 | 0.960 | 74.0 | 44.5 | 8800 | 94000 | 55% |
| magnetic toner 29 | 0.960 | 74.0 | 44.5 | 8800 | 94000 | 55% |
| magnetic toner 30 | 0.955 | 74.0 | 44.5 | 8800 | 94000 | 55% |
| magnetic toner 31 | 0.960 | 74.0 | 44.5 | 8800 | 94000 | 55% |

| | tanδ | toner Tg | particle diameter of the strongly fixed silica fine particles (nm) | maximum endothermic peak temperature (° C.) | saturation magnetization σs ($Am^2/kg$) | residual magnetization σs ($Am^2/kg$) | σr/σs |
|---|---|---|---|---|---|---|---|
| magnetic toner 1 | $4.0 \times 10^{-3}$ | 53° C. | 110 | 69 | 36.5 | 2.2 | 0.06 |
| magnetic toner 2 | $4.1 \times 10^{-3}$ | 53° C. | 150 | 69 | 36.5 | 2.2 | 0.06 |
| magnetic toner 3 | $4.0 \times 10^{-3}$ | 53° C. | 70 | 69 | 36.5 | 2.2 | 0.06 |
| magnetic toner 4 | $4.0 \times 10^{-3}$ | 53° C. | 110 | 69 | 32.0 | 2.7 | 0.08 |
| magnetic toner 5 | $4.2 \times 10^{-3}$ | 53° C. | 60 | 69 | 30.0 | 3.0 | 0.10 |
| magnetic toner 6 | $4.0 \times 10^{-3}$ | 51° C. | 180 | 64 | 31.5 | 3.4 | 0.11 |
| magnetic toner 7 | $4.1 \times 10^{-3}$ | 55° C. | 180 | 75 | 31.5 | 3.4 | 0.11 |
| magnetic toner 8 | $4.0 \times 10^{-3}$ | 47° C. | 50 | 50 | 31.5 | 3.4 | 0.11 |
| magnetic toner 9 | $4.0 \times 10^{-3}$ | 53° C. | 200 | 65 | 31.5 | 3.4 | 0.11 |
| magnetic toner 10 | $4.1 \times 10^{-3}$ | 53° C. | 200 | 71 | 31.5 | 3.4 | 0.11 |
| magnetic toner 11 | $4.0 \times 10^{-3}$ | 53° C. | 200 | 80 | 31.5 | 3.4 | 0.11 |
| magnetic toner 12 | $4.0 \times 10^{-3}$ | 55° C. | 200 | 88 | 31.5 | 3.4 | 0.11 |
| magnetic toner 13 | $4.2 \times 10^{-3}$ | 55° C. | 200 | 88 | 31.5 | 3.4 | 0.11 |
| magnetic toner 14 | $4.0 \times 10^{-3}$ | 55° C. | 200 | 88 | 31.5 | 3.4 | 0.11 |
| magnetic toner 15 | $3.9 \times 10^{-3}$ | 57° C. | 300 | 88 | 31.5 | 3.4 | 0.11 |
| magnetic toner 16 | $6.0 \times 10^{-3}$ | 60° C. | 300 | 88 | 38.2 | 4.2 | 0.11 |
| magnetic toner 17 | $8.0 \times 10^{-3}$ | 60° C. | 300 | 88 | 40.2 | 4.5 | 0.11 |
| magnetic toner 18 | $8.1 \times 10^{-3}$ | 65° C. | 300 | 88 | 40.1 | 4.5 | 0.11 |
| magnetic toner 19 | $8.2 \times 10^{-3}$ | 68° C. | 300 | 88 | 40.2 | 4.5 | 0.11 |
| magnetic toner 20 | $8.0 \times 10^{-3}$ | 68° C. | 300 | 88 | 40.0 | 4.6 | 0.11 |
| magnetic toner 21 | $8.0 \times 10^{-3}$ | 68° C. | 300 | 88 | 40.0 | 4.5 | 0.11 |
| magnetic toner 22 | $8.0 \times 10^{-3}$ | 68° C. | 300 | 88 | 40.0 | 4.5 | 0.11 |
| magnetic toner 23 | $8.1 \times 10^{-3}$ | 68° C. | 300 | 88 | 40.1 | 4.5 | 0.11 |
| magnetic toner 24 | $8.0 \times 10^{-3}$ | 68° C. | 300 | 88 | 40.3 | 4.4 | 0.11 |
| magnetic toner 25 | $8.0 \times 10^{-3}$ | 68° C. | 300 | 88 | 40.0 | 4.5 | 0.11 |
| magnetic toner 26 | $8.2 \times 10^{-3}$ | 68° C. | 300 | 88 | 40.0 | 4.5 | 0.11 |
| magnetic toner 27 | $8.0 \times 10^{-3}$ | 68° C. | 300 | 88 | 40.0 | 4.4 | 0.11 |
| magnetic toner 28 | $8.1 \times 10^{-3}$ | 68° C. | 300 | 88 | 40.0 | 4.5 | 0.11 |
| magnetic toner 29 | $8.0 \times 10^{-3}$ | 68° C. | 300 | 88 | 40.1 | 4.5 | 0.11 |
| magnetic toner 30 | $8.0 \times 10^{-3}$ | 68° C. | 300 | 88 | 40.0 | 4.5 | 0.11 |
| magnetic toner 31 | $8.0 \times 10^{-3}$ | 68° C. | 300 | 88 | 40.0 | 4.5 | 0.11 |

| | amount of weakly fixed silica fine particles (mass parts) | ratio of the medium-fixed silica fine particles to the amount of weakly fixed silica fine particles | coverage ratio X by the strongly fixed silica fine particles | particle diameter ratio of the silica fine particles (strongly fixed/weakly fixed) |
|---|---|---|---|---|
| comparative magnetic toner 1 | 6.00 | 2.81 | 41.2 | 0.4 |
| comparative magnetic toner 2 | 0.24 | 2.33 | 95.0 | 0.4 |
| comparative magnetic toner 3 | 0.12 | 5.67 | 72.1 | 0.4 |
| comparative magnetic toner 4 | 0.08 | 4.63 | 72.1 | 0.4 |
| comparative magnetic toner 5 | 0.31 | 2.23 | 72.0 | 0.4 |
| comparative magnetic toner 6 | 0.22 | 11.73 | 20.0 | 0.4 |
| comparative magnetic toner 7 | 8.80 | 0.80 | 72.0 | 0.1 |
| comparative magnetic toner 8 | 0.22 | 0.50 | 71.9 | 0.1 |
| comparative magnetic toner 9 | 1.50 | 0.67 | 73.0 | 0.2 |
| comparative magnetic toner 10 | 0.50 | 0.40 | 72.0 | 0.2 |
| comparative magnetic toner 11 | 0.45 | 0.33 | 71.8 | 0.4 |

TABLE 6-continued

| | | | | |
|---|---|---|---|---|
| comparative magnetic toner 12 | 2.90 | 0.21 | 73.1 | 0.1 |
| comparative magnetic toner 13 | 0.50 | 0.60 | 72.0 | 1.0 |
| comparative magnetic toner 14 | 0.45 | 0.78 | 1.0 | 0.0 |

| | average circularity | softening temperature (Ts) | softening point (Tm) − softening temperature (Ts) | GPC; main peak (MA) | GPC; subpeak (MB) | main peak area ratio; SA/(SA + SB) |
|---|---|---|---|---|---|---|
| comparative magnetic toner 1 | 0.958 | 74.0 | 44.5 | 8800 | 94000 | 55% |
| comparative magnetic toner 2 | 0.958 | 74.0 | 44.5 | 8800 | 94000 | 55% |
| comparative magnetic toner 3 | 0.958 | 74.0 | 44.5 | 8800 | 94000 | 55% |
| comparative magnetic toner 4 | 0.958 | 74.0 | 44.5 | 8800 | 94000 | 55% |
| comparative magnetic toner 5 | 0.958 | 74.0 | 44.5 | 8800 | 94000 | 55% |
| comparative magnetic toner 6 | 0.942 | 74.0 | 43.0 | 8800 | 94000 | 55% |
| comparative magnetic toner 7 | 0.960 | 74.0 | 44.5 | 8800 | 94000 | 55% |
| comparative magnetic toner 8 | 0.960 | 74.0 | 44.5 | 8800 | 94000 | 55% |
| comparative magnetic toner 9 | 0.958 | 74.0 | 44.5 | 8800 | 94000 | 55% |
| comparative magnetic toner 10 | 0.958 | 74.0 | 44.5 | 8800 | 94000 | 55% |
| comparative magnetic toner 11 | 0.958 | 74.0 | 44.5 | 8800 | 94000 | 55% |
| comparative magnetic toner 12 | 0.958 | 74.0 | 44.5 | 8800 | 94000 | 55% |
| comparative magnetic toner 13 | 0.958 | 74.0 | 44.5 | 8800 | 94000 | 55% |
| comparative magnetic toner 14 | 0.960 | 74.0 | 43.0 | 8800 | 94000 | 55% |

| | tanδ | toner Tg | particle diameter of the strongly fixed silica fine particles (nm) | maximum endothermic peak temperature (° C.) | saturation magnetization σs ($Am^2/kg$) | residual magnetization σs ($Am^2/kg$) | σr/σs |
|---|---|---|---|---|---|---|---|
| comparative magnetic toner 1 | $8.0 \times 10^{-3}$ | 68° C. | 300 | 88 | 40.0 | 4.5 | 0.11 |
| comparative magnetic toner 2 | $8.0 \times 10^{-3}$ | 68° C. | 300 | 88 | 40.0 | 4.5 | 0.11 |
| comparative magnetic toner 3 | $8.0 \times 10^{-3}$ | 68° C. | 300 | 88 | 40.2 | 4.5 | 0.11 |
| comparative magnetic toner 4 | $8.0 \times 10^{-3}$ | 68° C. | 300 | 88 | 40.0 | 4.4 | 0.11 |
| comparative magnetic toner 5 | $8.0 \times 10^{-3}$ | 68° C. | 300 | 88 | 40.0 | 4.5 | 0.11 |
| comparative magnetic toner 6 | $8.0 \times 10^{-3}$ | 68° C. | 300 | 88 | 40.3 | 4.5 | 0.11 |
| comparative magnetic toner 7 | $8.0 \times 10^{-3}$ | 68° C. | 300 | 88 | 40.0 | 4.6 | 0.11 |
| comparative magnetic toner 8 | $8.0 \times 10^{-3}$ | 68° C. | 300 | 88 | 40.0 | 4.5 | 0.11 |
| comparative magnetic toner 9 | $8.0 \times 10^{-3}$ | 68° C. | 300 | 88 | 40.0 | 4.5 | 0.11 |
| comparative magnetic toner 10 | $8.0 \times 10^{-3}$ | 68° C. | 300 | 88 | 40.1 | 4.6 | 0.11 |
| comparative magnetic toner 11 | $8.0 \times 10^{-3}$ | 68° C. | 300 | 88 | 40.0 | 4.5 | 0.11 |
| comparative magnetic toner 12 | $8.0 \times 10^{-3}$ | 68° C. | 300 | 88 | 40.0 | 4.5 | 0.11 |
| comparative magnetic toner 13 | $8.0 \times 10^{-3}$ | 68° C. | 300 | 88 | 40.2 | 4.4 | 0.11 |
| comparative magnetic toner 14 | $8.0 \times 10^{-3}$ | 68° C. | — | 88 | 40.0 | 4.5 | 0.11 |

(*1) The ratio of the number-average particle diameter (D1) of the primary particles of the strongly fixed silica fine particles (third inorganic fine particles) to the number-average particle diameter (D1) of the primary particles of the weakly fixed silica fine particles (first inorganic fine particles). In addition, the amount of weakly fixed silica fine particles represents the content in 100 mass parts of the magnetic toner.

Example 1

Charge Rising Behavior

The charge rising behavior of the toner was evaluated as follows.

Figure 8:
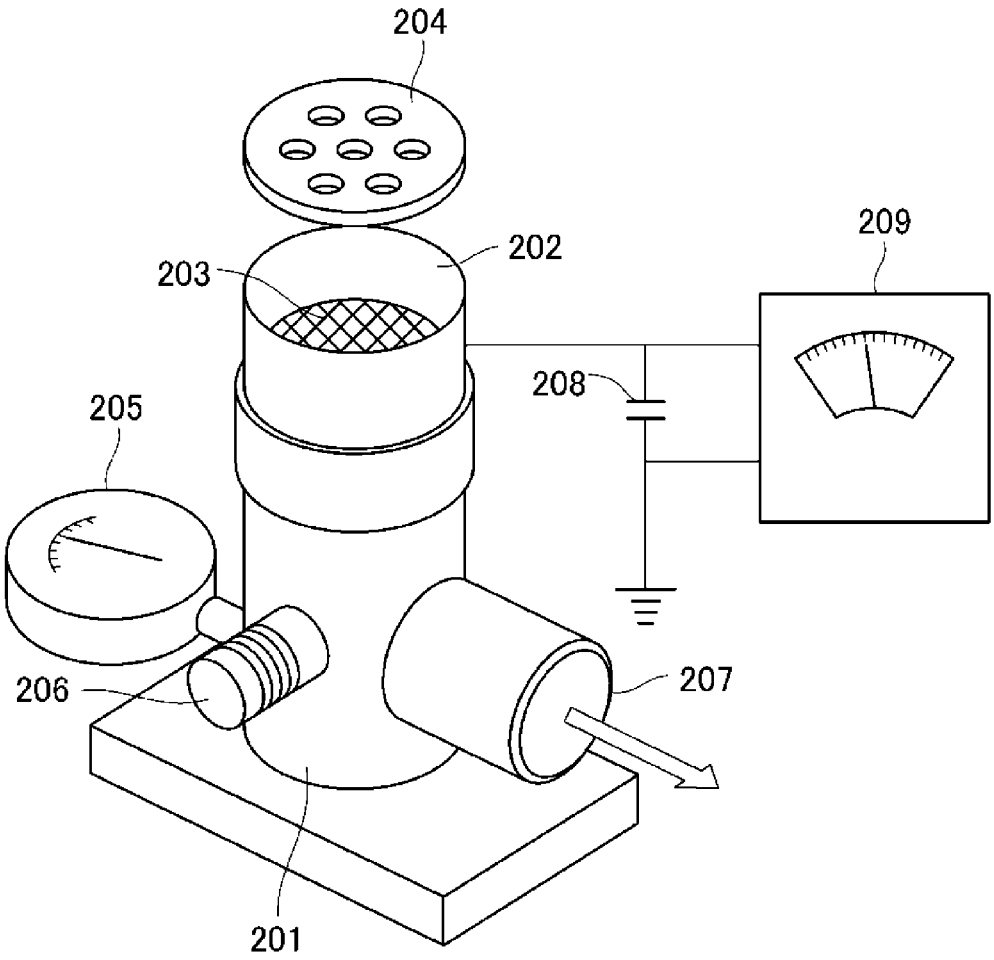
FIG. 8 is a schematic diagram of an apparatus for measuring the amount of charge.

The magnetic toner at the back of the sleeve is recovered from the cartridge after the completion of the image output evaluation with the LBP3100 that is described below. 1.0 g of the recovered magnetic toner and 9.0 g of a resin-coated ferrite carrier are introduced into a 50-cc polyethylene bin. This bin is allowed to stand for 24 hours at normal temperature and normal pressure and is thereafter placed in a shaker (Yayoi Co., Ltd.) and is shaken for 10 seconds at a speed of 100 back-and-forth excursions per minute, after which the quantity of charge is measured using the charge quantity measurement device shown in FIG. 8.

This method for measuring the quantity of charge will be described in detail. First, with regard to the quantity of charge, approximately 0.5 to 1.5 g of the toner and carrier mixture is introduced after shaking into a metal measurement container 202 having a 500-mesh screen 203 at the bottom and a metal cap 204 is applied. The weight of the entire measurement container 202 at this point is weighed and this value is designated $W_1$ (g). Then, with the suction apparatus 201 (at least the part in contact with the measurement container 202 is an insulator), suction is carried out through a suction port and the pressure on the vacuum gauge 205 is brought to 250 mmAq by adjusting the air quantity control valve 206. Suction is carried out in this state to suction off the toner fully and preferably for 2 minutes. The potential on the potentiometer 209 at this time is designated V (in volts). Here, 208 refers to a capacitor, and its capacity is designated C (μF). The weight of the entire measurement container is then measured post-suction and designated $W_2$ (g). The triboelectric charge quantity (mC/kg) of the toner is then calculated with the following formula using the values measured as described in the preceding.

$$\text{triboelectric change quantity of the toner (mC/kg)} = \frac{C \times V}{W_1 - W_2}$$

The triboelectric charge quantity after shaking for 10 seconds and obtained by the method described above is designated Q10.

In addition, designating Qm to be the triboelectric charge quantity obtained using a shaking time of 2 minutes, the evaluation was carried out using the idea that the charge rising behavior is better as the ratio of Q10 to Qm (Q10/Qm) is closer to 1.00.

The ferrite carrier used was prepared by the application of an approximately 1 weight % coating of a 50:50 mixture of polyvinylidene fluoride and styrene-methyl methacrylate copolymer to a Cu—Zn—Fe ternary ferrite core (approximately 50% Fe, approximately 10% Cu, and approximately 10% Zn). For both Q10 and Qm, the same experiment was run three times and the evaluation was carried out using their average values.

<Image Density>

300 g of magnetic toner 1 was introduced into a cartridge for an LBP3100; this cartridge had a small-diameter developing sleeve with a diameter of 10 mm. Holding for 30 days in an environment with a temperature of 40° C. and a humidity of 95% was then carried out.

The embedding of inorganic fine particles at the magnetic toner surface can be promoted by additionally carrying out holding in an environment having a higher temperature and higher humidity than the environment in which electrophotographic devices are frequently used. In addition, the ease with which the charge rises can be rigorously evaluated by using an image-forming apparatus equipped with a small-diameter developing sleeve.

After the holding cycle as described above, the cartridge was installed in an LBP3100 and, after standing overnight in a high-temperature, high-humidity environment (32.5° C./80% RH), 6,000 prints were output, operating in a one-minute intermittent mode, of horizontal lines with a print percentage of 1%. This was followed by an additional overnight holding period and then the continuous output of 3 solid image prints. The densities of the 3 solid image prints were measured using a MacBeth reflection densitometer (MacBeth Corporation), wherein a higher numerical value for the lowest reflection density was regarded as better.

(Fogging)

After the image density evaluation as described above, the LBP3100 was held for 24 hours in a normal-temperature, normal-humidity environment, and one print of a white image was then output and its reflectance was measured using a Reflectometer Model TC-6DS from Tokyo Denshoku Co., Ltd. On the other hand, the reflectance was also measured in the same manner on the transfer paper (standard paper) prior to formation of the white image. A green filter was used for the filter. The fogging was calculated using the following formula from the reflectance prior to output of the white image and the reflectance after output of the white image. The evaluation was performed based on the idea that a lower numerical value was better.

fogging (reflectance) (%)=reflectance (%) of the standard paper−reflectance (%) of the white image sample (The Fixation Temperature Region)

The fixation temperature region was evaluated using the width between the low-temperature fixation temperature and the hot offset appearance temperature. First, a solid image was output at 10° C. decrements of the heater temperature in the fixing unit at the start of the durability test. The low-temperature fixation temperature was taken to be the temperature at which evaluation C in the following evaluation criteria appeared.

A: Problem-free; sticking to the fingers does not occur even when the solid image is rubbed.

B: Some sticking to the fingers occurs when the solid image is rubbed, but there is no problem with, for example, a text image.

C: Some concern; detachment occurs at some locations both with strong rubbing of the solid image and strong rubbing of a text image.

Then, while raising the heater temperature in the fixing unit at the start of the durability test in 10° C. increments, 1 print of a horizontal line image with a print percentage of 1% was made followed immediately by the output of a white image. The hot offset appearance temperature was taken to be the temperature at which evaluation C in the following evaluation criteria appeared.

A: Smudging in the white image is entirely absent.

B: Slight smudging occurs in the white image.

C: Smudging clearly occurs in the white image.

The evaluation was made here that a larger difference between the hot offset appearance temperature and the low-temperature fixation temperature indicated a broader fixing region and was better.

Examples 2 to 31 and Comparative Examples 1 to 14

Evaluations were performed under the same conditions as in Example 1 using magnetic toners 2 to 31 and comparative magnetic toners 1 to 14 as the magnetic toner. The results of the evaluations are given in Table 7.

TABLE 7-1

| | toner under evaluation | charge rising behavior | fogging | image density | fixation temperature region (° C.) |
|---|---|---|---|---|---|
| Example 1 | magnetic toner 1 | 0.95 | 0.21 | 1.52 | 65 |
| Example 2 | magnetic toner 2 | 0.95 | 0.22 | 1.51 | 65 |
| Example 3 | magnetic toner 3 | 0.94 | 0.22 | 1.52 | 65 |
| Example 4 | magnetic toner 4 | 0.95 | 0.21 | 1.53 | 65 |
| Example 5 | magnetic toner 5 | 0.94 | 0.22 | 1.52 | 65 |
| Example 6 | magnetic toner 6 | 0.94 | 0.21 | 1.48 | 65 |
| Example 7 | magnetic toner 7 | 0.94 | 0.22 | 1.47 | 65 |
| Example 8 | magnetic toner 8 | 0.94 | 0.25 | 1.48 | 62 |
| Example 9 | magnetic toner 9 | 0.94 | 0.26 | 1.48 | 62 |
| Example 10 | magnetic toner 10 | 0.94 | 0.25 | 1.48 | 62 |
| Example 11 | magnetic toner 11 | 0.94 | 0.26 | 1.47 | 60 |
| Example 12 | magnetic toner 12 | 0.94 | 0.25 | 1.48 | 60 |
| Example 13 | magnetic toner 13 | 0.94 | 0.26 | 1.48 | 60 |
| Example 14 | magnetic toner 14 | 0.93 | 0.26 | 1.45 | 60 |
| Example 15 | magnetic toner 15 | 0.92 | 0.25 | 1.41 | 60 |
| Example 16 | magnetic toner 16 | 0.92 | 0.25 | 1.41 | 58 |
| Example 17 | magnetic toner 17 | 0.86 | 0.50 | 1.39 | 58 |
| Example 18 | magnetic toner 18 | 0.86 | 0.51 | 1.39 | 54 |
| Example 19 | magnetic toner 19 | 0.86 | 0.50 | 1.39 | 50 |
| Example 20 | magnetic toner 20 | 0.86 | 0.52 | 1.38 | 50 |
| Example 21 | magnetic toner 21 | 0.86 | 0.51 | 1.38 | 50 |
| Example 22 | magnetic toner 22 | 0.86 | 0.50 | 1.39 | 50 |
| Example 23 | magnetic toner 23 | 0.86 | 0.50 | 1.39 | 50 |
| Example 24 | magnetic toner 24 | 0.84 | 0.52 | 1.38 | 50 |
| Example 25 | magnetic toner 25 | 0.84 | 0.55 | 1.37 | 50 |
| Example 26 | magnetic toner 26 | 0.84 | 0.55 | 1.37 | 50 |
| Example 27 | magnetic toner 27 | 0.84 | 0.52 | 1.36 | 50 |
| Example 28 | magnetic toner 28 | 0.80 | 0.60 | 1.35 | 50 |
| Example 29 | magnetic toner 29 | 0.80 | 0.63 | 1.35 | 50 |
| Example 30 | magnetic toner 30 | 0.80 | 0.75 | 1.35 | 50 |
| Example 31 | magnetic toner 31 | 0.80 | 0.60 | 1.36 | 50 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-269666, filed Dec. 26, 2013, which is hereby incorporated by reference herein in its entirety.

REFERENCE SIGNS LIST

51: magnetic toner particle, 52: autofeeder, 53: feed nozzle, 54: surface modification apparatus interior, 55: hot air current introduction port, 56: cold air current introduction port, 57: surface-modified magnetic toner particle, 58: cyclone, 59: blower

1: main casing, 2: rotating member, 3, 3*a*, 3*b*: stirring member, 4: jacket, 5: raw material inlet port, 6: product discharge port, 7: central axis, 8: drive member, 9: processing space, 10: end surface of the rotating member, 11: direction of rotation, 12: back direction, 13: forward direction, 16: raw material inlet port inner piece, 17: product discharge port inner piece, d: distance that represents the overlapping portion of a stirring member, D: stirring member width

100: electrostatic latent image-bearing member (photoreceptor), 102: developing sleeve, 114: transfer member (transfer roller), 116: cleaner, 117: charging member (charging roller), 121: laser generator (latent image-forming means, photoexposure device), 123: laser, 124: register roller, 125: transport belt, 126: fixing unit, 140: developing device, 141: stirring member

201: suction apparatus, 202: measurement container, 203: screen, 204: cap, 205: vacuum gauge, 206: air quantity control valve, 207: suction port, 208: capacitor, 209: potentiometer

The invention claimed is:

1. A magnetic toner comprising:

a magnetic toner particle having an average circularity of at least 0.955, and containing a binder resin, a magnetic body and inorganic fine particles fixed to the surface of the magnetic toner particle, wherein when classifying the inorganic fine particles, in accordance with the fixing strength thereof to the magnetic toner particle and in the sequence of the weakness of the fixing strength, as first inorganic fine particles having weak fixing strength that are detached when a dispersion provided by the addition of the magnetic toner to surfactant-containing ion-exchanged water is shaken for 2 minutes at a shaking velocity of 46.7 cm/sec and a shaking amplitude of 4.0 cm, second inorganic fine particles having medium fixing strength that are not detached by the shaking, but are detached by ultrasonic dispersion for 30 minutes at an intensity of 120 W/cm$^2$, and third inorganic fine particles having strong fixing strength that are not detached by the shaking and the ultrasonic dispersion, the third inorganic fine particles are silica fine particles, (1) the content of the first inorganic fine particles is 0.10 to 0.30 mass parts in 100 mass parts of the magnetic toner;

(2) the second inorganic fine particles are present at 2.0 to 5.0-times the first inorganic fine particles; and (3) the coverage ratio X of the magnetic toner surface by the third inorganic fine particles is 60.0 to 90.0 area % as determined with an x-ray photoelectron spectrometer, and the number average particle diameter (D1) of primary particles of the third inorganic fine particles is from 60 to 180 nm.

2. The magnetic toner according to claim 1, wherein the softening temperature (Ts) of the magnetic toner is from 60.0° C. to 73.0° C., and the difference between the softening point (Tm) of the magnetic toner and the softening temperature (Ts) is from 45.0° C. to 57.0° C.

3. The magnetic toner according to claim 1, wherein a molecular weight distribution of the tetrahydrofuran (THF)-soluble matter of the magnetic toner as measured by gel permeation chromatography (GPC) has a peak top for a main peak in a molecular weight region of from 4,000 to 8,000, has a peak top for a subpeak in a molecular weight range of from 100,000 to 500,000, and has a ratio ($S_A$/($S_A$ +$S_B$)) of a main peak area ($S_A$) to the total area of the main peak area ($S_A$) and a subpeak area ($S_B$) of at least 70%.

4. The magnetic toner according to claim 1, wherein the dielectric loss tangent (tan δ) of the magnetic toner is not more than $6.0\times10^{-3}$.

5. The magnetic toner according to claim 1, wherein the glass transition temperature of the magnetic toner is from 47° C. to 57° C.

6. The magnetic toner according to claim 1, wherein the ratio of the number-average particle diameter (D1) of primary particles of the third inorganic fine particles to the number-average particle diameter (D1) of primary particles of the first inorganic fine particles is from 4.0 to 25.0.

7. The magnetic toner according to claim 1, wherein the saturation magnetization (σs) of the magnetic toner is from 30.0 $Am^2/kg$ to 40.0 $Am^2/kg$, and the ratio [σr/σs] between the residual magnetization (σr) of the magnetic toner and the saturation magnetization (σs) is from 0.03 to 0.10.

8. The magnetic toner according to claim 1, wherein the first and second inorganic fine particles are silica fine particles.

9. The magnetic toner according to claim 1, wherein the binder resin is a styrenic resin.

10. The magnetic toner according to claim 1, wherein the number average particle diameter (D1) of the primary particles of the first inorganic fine particles and/or the second inorganic fine particles is from 5 nm to 30 nm.

11. The magnetic toner according to claim 1, wherein the first and second inorganic fine particles are independently selected from the group consisting of silica fine particles, titania fine particles, and alumina fine particles.

12. The magnetic toner according to claim 1, wherein the content of the third inorganic fine particles is 2.6 to 4.8 mass parts in 100 mass parts of the magnetic toner particle.

13. The magnetic toner according to claim 1, wherein the magnetic toner contains an ester compound and has a maximum endothermic peak of 50 to 80° C. as measured with a differential scanning calorimeter (DSC).

14. The magnetic toner according to claim 13, wherein the ester compound is a monofunctional ester compound having from 36 to 48 carbons.

* * * * *